US011110482B2

(12) United States Patent
Tanaka

(10) Patent No.: US 11,110,482 B2
(45) Date of Patent: Sep. 7, 2021

(54) DISCHARGE SYSTEM

(71) Applicant: Heishin Ltd., Hyogo (JP)

(72) Inventor: Yusuke Tanaka, Shiga (JP)

(73) Assignee: HEISHIN LTD., Hyogo (JP)

( * ) Notice: Subject to any disclaimer, the term of this patent is extended or adjusted under 35 U.S.C. 154(b) by 51 days.

(21) Appl. No.: 16/512,080

(22) Filed: Jul. 15, 2019

(65) Prior Publication Data

US 2019/0337009 A1 Nov. 7, 2019

Related U.S. Application Data

(63) Continuation of application No. 15/033,051, filed as application No. PCT/JP2014/075996 on Sep. 30, 2014, now abandoned.

(30) Foreign Application Priority Data

Oct. 29, 2013 (JP) ..... 2013-224658

(51) Int. Cl.
*B05C 11/10* (2006.01)
*B05C 5/02* (2006.01)

(52) U.S. Cl.
CPC ..... *B05C 11/10* (2013.01); *B05C 5/02* (2013.01); *B05C 5/0225* (2013.01); *B05C 11/1026* (2013.01); *B05C 11/1047* (2013.01)

(58) Field of Classification Search
CPC . B05C 11/10; B05C 11/1026; B05C 11/1047; B05C 5/02; B05C 5/0225;
(Continued)

(56) References Cited

U.S. PATENT DOCUMENTS 2,505,919 A * 5/1950 Simpson, Jr. ..... H01J 47/06 313/93
2,810,494 A ‡ 10/1957 Smith ..... F16J 15/0881 220/240

(Continued)

FOREIGN PATENT DOCUMENTS

JP 2004-154733 A ‡ 6/2004
JP 2004-154733 A 6/2004

(Continued)

OTHER PUBLICATIONS

English machine translation of Kiichi (JP 2004-154733), published Jun. 2004.*

(Continued)

*Primary Examiner* — Andrew D St. Clair
(74) *Attorney, Agent, or Firm* — Masuvalley & Partners

(57) ABSTRACT

The purpose is to provide a discharge system which can minimize wear of a connecting part of a discharging device and a refilling device which is caused under the influence of particulate matters contained in fluid even if connection and disconnection for refilling the discharging device with the fluid is repeated. A discharge system includes a discharging device capable of discharging the fluid, and a refilling device capable of refilling the discharging device with the fluid. The fluid is suppliable from the refilling device side to the discharging device side by inserting one of a discharge-side coupler provided to the discharging device side and a refill-side coupler provided to the refilling device side into the other to connect the discharging device to the refilling device. A clearance size d formed between the discharge-side coupler and the refill-side coupler is determined based on the particle size distribution of the particulate matters that constitutes the fluid.

6 Claims, 19 Drawing Sheets

(58) Field of Classification Search
CPC ..... B05B 13/0431; F16L 29/00; F16L 37/30; F16L 37/38
See application file for complete search history.

(56) References Cited

U.S. PATENT DOCUMENTS

| | | | | | |
|---|---|---|---|---|---|
| 2,854,744 | A * | 10/1958 | Crockett | F02K 9/343 | 29/516 |
| 3,620,417 | A * | 11/1971 | Simms | B65D 81/325 | 222/136 |
| 4,009,286 | A ‡ | 2/1977 | Moll | C12C 5/02 | 426/13 |
| 4,059,296 | A * | 11/1977 | Panourgias | F16L 37/18 | 285/312 |
| 4,278,276 | A * | 7/1981 | Ekman | F16L 37/0885 | 285/49 |
| 4,693,775 | A ‡ | 9/1987 | Harrison | B29C 66/742 | 156/244.17 |
| 5,033,777 | A * | 7/1991 | Blenkush | F16L 37/0841 | 285/317 |
| 5,211,197 | A ‡ | 5/1993 | Marrison | F16L 37/23 | 137/614 |
| 5,358,821 | A ‡ | 10/1994 | Bertrand | G03G 9/0804 | 430/110.2 |
| 5,529,085 | A ‡ | 6/1996 | Richards | F16K 17/40 | 137/68.15 |
| 7,040,359 | B2 ‡ | 5/2006 | Younkle | B05B 1/265 | 141/255 |
| 2005/0079010 | A1 * | 4/2005 | Droppleman | F16B 21/04 | 403/348 |
| 2006/0016510 | A1 ‡ | 1/2006 | Porter | B05C 5/001 | 141/2 |
| 2006/0046093 | A1 ‡ | 3/2006 | Landry | C09K 11/025 | 428/690 |
| 2009/0026400 | A1 * | 1/2009 | Chen | F16L 37/42 | 251/149.1 |

FOREIGN PATENT DOCUMENTS

| | | | |
|---|---|---|---|
| JP | 2004-536696 | A ‡ | 12/2004 |
| JP | 2004-536696 | A | 12/2004 |
| JP | 2007-275769 | A ‡ | 10/2007 |
| JP | 2011-190835 | A ‡ | 9/2011 |
| JP | 2011-190835 | A | 9/2011 |
| JP | 2012-13200 | A ‡ | 1/2012 |

OTHER PUBLICATIONS

WIPO, Japanese International Search Authority, International Search Report and Written Opinion dated Dec. 9, 2014 in International Patent Application No. PCT/JP2014/075996, 10 pages.‡

* cited by examiner
‡ imported from a related application 22
32
38b
38
40
46

22
46

22
30
42
34c
38a,40a
34b
34
34a
44
38b
40
38
32

22

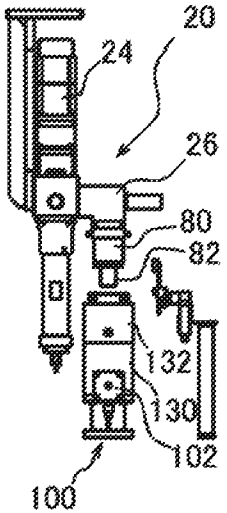
FIG. 16A
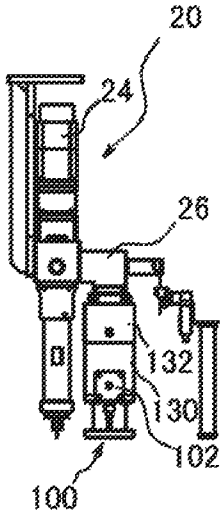
FIG. 16B
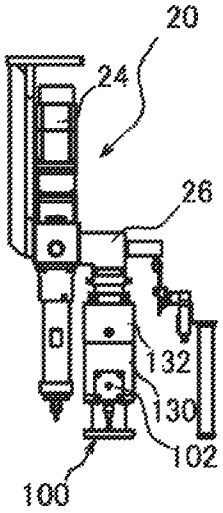
FIG. 16C
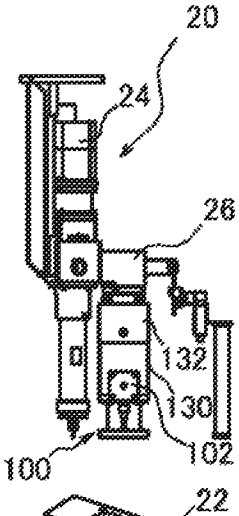
FIG. 16D
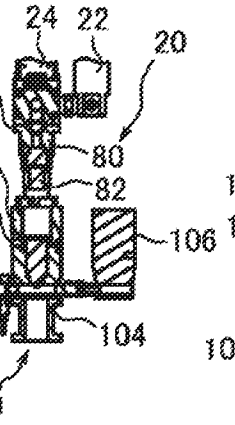
FIG. 16E
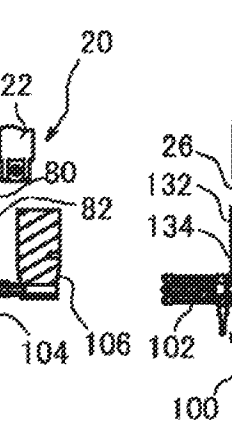
FIG. 16F
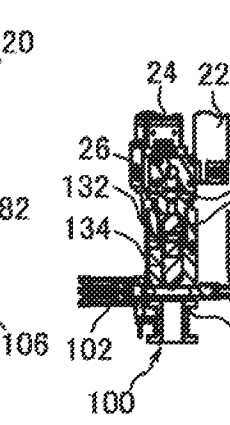
FIG. 16G
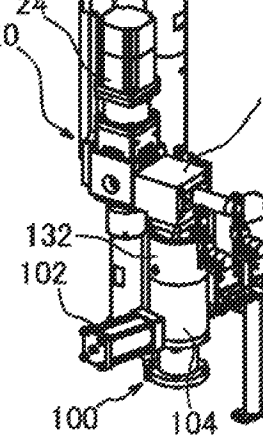
FIG. 16H
FIG. 16I

DISCHARGE SYSTEM

RELATED APPLICATIONS

This application is a continuation of and claims priority to U.S. patent application Ser. No. 15/033,051 filed Apr. 28, 2016 entitled Discharge System, which is the U.S. National Phase of and claims priority to International Patent Application No. PCT/JP2014/075996, International Filing Date Sep. 30 2014, entitled DISCHARGING SYSTEM; which claims benefit of Japanese Patent Application No. 2013-224658 filed Oct. 29, 2013; all of which are incorporated herein by reference in their entireties.

TECHNICAL FIELD

The present invention relates to a discharge system capable of using fluid, for example, capable of applying fluid, such as sealing agent or adhesive, to various components at an automobile assembly plant etc., or refilling a container with fluid, such as grease.

BACKGROUND ART

Conventionally, as listed below, a device and a method for applying a functional fluid material disclosed in Patent Document 1: JP2004-154733A, or a connector for fluid, an application device, etc. which are disclosed in Patent Document 2: JP2007-275769A, are used for applications in which fluid, such as sealing agent or adhesive, is applied at an automobile assembly plant etc. The application device according to Patent Document 1 is comprised of an application unit and a refilling unit. In this application device, the application unit has a discharge gun which discharges the functional fluid material, and a feeder which supplies the functional fluid material to the discharge gun. The refilling unit refills the functional fluid material from a refilling port to a refilling tube part. By adopting such a structure, a long-distance piping for supplying the functional fluid material to the discharge gun is no longer necessary, and a significant shortening of piping length is achieved, and a temperature adjusting device for temperature control of the fluid material and a fluid-feeding pump are made necessary minimum.

Purposes of the fluid connector and the application device which are disclosed in Patent Document 2 are also to eliminate a large-scale piping installation for supplying the fluid from a tank to a discharger, and a high-pressure pump for carrying the fluid, similar to Patent Document 1. The conventional art of Patent Document 2 is provided with first to third feeding parts for supplying the fluid, such as sealing agent, and first to third dischargers, which are detachably attached to the respective first to third feeding parts etc. via connectors for fluid. The first to third dischargers have tanks for storing the fluid supplied from the feeding parts to which the first to third dischargers are attached, respectively, and are dischargeable of the fluid from the tanks. The first to third dischargers are attachable and detachable to/from an arm of a robot via a second connector, respectively.

SUMMARY OF THE INVENTION

As described above, various discharge systems are provided in which the discharging device for discharging the discharge fluid and the refilling device for refilling the discharging device with the fluid are provided so as to be connectable and disconnectable, and the fluid is refillable from the refilling device side to the discharging device side by connecting both the devices.

Here, in the discharge system, fluid which contains particulate matters (slurry) may be used. When handing such fluid, the particulate matters contained in the fluid may be caught in a clearance of a connecting part between the discharging device and the refilling device. Therefore, if the clearance between the discharging device and the refilling device is smaller than the size of the particulate matters contained in the fluid, the connecting part of the discharging device and the refilling device may be worn while the connection and disconnection for refilling the fluid are repeated in the state where the particulate matters are caught. If the connecting part of the discharging device and the refilling device is worn, a secondary problem, such as mixing of the fluid with wear matters entered from gaps formed at worn parts, leaking of the fluid from the worn parts when refilling the fluid, may arise.

Thus, one purpose of the present invention is to provide a discharge system which can minimize the wear of the connecting part of the discharging device and the refilling device which is caused under the influence of the particulate matters contained in the fluid even if the connection and disconnection for refilling the discharging device with the fluid is repeated.

In order to solve the subject described above, according to one aspect of the present invention, a discharge system is provided, which includes a discharging device capable of discharging fluid, and a refilling device capable of refilling the discharging device with the fluid. The fluid is suppliable from the refilling device side to the discharging device side by inserting one of a discharge-side coupler provided to the discharging device side and a refill-side coupler provided to the refilling device side into the other to connect the discharging device to the refilling device. A clearance between the discharge-side coupler and the refill-side coupler that is formed in a connected state of the discharge-side coupler and the refill-side coupler is determined based on a particle size distribution of particulate matters that constitutes the fluid.

In the discharge system of the present invention, the clearance formed in the connected state of the discharge-side coupler and the refill-side coupler is determined considering the particle size distribution of the particulate matters that constitute the fluid. Therefore, according to the discharge system of the present invention, even when fluid which contains particulate matters is handled, wear of the discharge-side coupler and the refill-side coupler which is caused under the influence of the particulate matters, can be minimized.

In the discharge system of the present invention described above, the clearance may be equal to or greater than a median of the particle size distribution.

By adopting such a configuration, large particulate matters corresponding to the size equal to or greater than the median of the particle size distribution being caught at the clearance can be avoided, and the wear of the connecting part of the discharge-side coupler and the refill-side coupler can be minimized.

In the discharge system of the present invention described above, the clearance may be equal to or greater than a mode diameter of the particle size distribution.

In the discharge system of the present invention, a particulate matter diameter of which frequency of appearance is highest of particulates contained in the fluid, in other words, a mode diameter that is the maximum value in the particle size distribution, is a reference for determining the clearance. Therefore, by determining the clearance between the discharge-side coupler and the refill-side coupler to be greater than the mode diameter as in the present invention, the wear of both the couplers can be minimized.

In the discharge system of the present invention described above, the clearance may be equal to or greater than a median diameter of the particle size distribution.

In the discharge system of the present invention, the median diameter is the determination reference of the clearance, and the clearance between the discharge-side coupler and the refill-side coupler is determined to be greater than the median diameter. Also with this configuration, wear associated with connection and disconnection of the discharge-side coupler to/from the refill-side coupler can be minimized.

In the discharge system of the present invention described above, the clearance may be equal to or greater than a mean diameter of the particle size distribution.

In the discharge system of the present invention, the mean diameter of the particle size distribution is adopted as the determination reference of the clearance, and the clearance between the discharge-side coupler and the refill-side coupler is determined to be greater than the mean diameter. With this configuration, the wear associated with the connection and disconnection of the discharge-side coupler to/from the refill-side coupler can be minimized.

In the discharge system of the present invention described above, the clearance may be equal to or greater than the largest one among a median, a mode diameter, a median diameter, and a mean diameter of the particle size distribution.

In the discharge system of the present invention, the median, the mode diameter, the median diameter, and the mean diameter are derived for the particle size distribution, and the clearance is determined to be greater than the largest one among them. Thus, the particle size distribution is comprehensively evaluated in terms of the median, the mode diameter, the median diameter, and the mean diameter, and the optimization of the clearance is achieved. Therefore, according to the present invention, the wear associated with the connection and disconnection of the discharge-side coupler to/from the refill-side coupler can further certainly be reduced.

Further, in the discharge system of the present invention described above, where a standard deviation of the particle size distribution is $\sigma$, the clearance may be equal to or greater than a $n \cdot \sigma$ value that corresponds to a given multiple of the standard deviation $\sigma$.

By adopting such a configuration, it can be prevented that large particulate matters of which size exceeds the range of the $n \cdot \sigma$ value that corresponds to the given multiple of the standard deviation $\sigma$ of the particle size distribution are caught at the clearance between the discharge-side coupler and the refill-side coupler. Thus, the wear at the connecting part of the discharge-side coupler and the refill-side coupler can be minimized.

Further, in the discharge system of the present invention described above, the clearance may be equal to or greater than a grain size of the larger one among a median of the particle size distribution, and a $n \cdot \sigma$ value that corresponds to a given multiple of a standard deviation $\sigma$ of the particle size distribution.

In the discharge system of the present invention, the clearance is considered and determined in terms of both the median of the particle size distribution and the $n \cdot \sigma$ value. Specifically, in the discharge system of the present invention, the larger one among the median of the particle size distribution and the $n \cdot \sigma$ value is adopted as a reference value for determining the clearance, and the clearance is adjusted to be greater than the reference value. Therefore, the wear at the connecting part of the discharge-side coupler and the refill-side coupler can further certainly be reduced.

In the discharge system of the present invention described above, a hardness of a sliding part that slides when connecting and disconnecting the discharge-side coupler to/from the refill-side coupler may be equal to or greater than a hardness of the particulate matters, the sliding part being a surface of either one or both of the discharge-side coupler and the refill-side coupler.

By adopting such a configuration, it can be prevented that the sliding part that slides when connecting and disconnecting the discharge-side coupler to/from the refill-side coupler is worn under the influence of the particulate matters.

The discharge system of the present invention described above is suitably available in a case where the discharge device includes a uniaxial eccentric screw pump having a male screw rotor that is eccentrically rotated by receiving a drive force and a stator of which an inner circumferential surface is formed in a female screw.

In the discharge system of the present invention, since the discharge device includes the uniaxial eccentric screw pump, it can discharge the fluid quantitatively and stably without causing fluctuation etc. of the fluid even if the fluid contains the particulate matters. Thus, the present invention has a configuration in which the discharge device includes the uniaxial eccentric screw pump and is suitably available in applications where the fluid containing the particulate matters is used.

According to the present invention, the discharge system can be provided, which can minimize the wear of the connecting part of the discharging device and the refilling device which is caused under the influence of the particulate matters contained in the fluid even if the connection and disconnection for refilling the discharging device with the fluid is repeated.

BRIEF DESCRIPTION OF THE DRAWINGS

FIG. 2A is a left-side view, FIG. 2B is a front view, FIG. 2C is a plan view, FIG. 2D is a cross-sectional view, and FIG. 2E is a perspective view.

FIG. 3A is a front view, FIG. 3B is a cross-sectional view, FIG. 3C is a perspective view, and FIG. 3D is a plan view.

FIG. 6A is a front view, FIG. 6B is a right-side view, FIG. 6C is a cross-sectional view, and FIG. 6D is a plan view.

FIG. 9A is a side view, FIG. 9B is a front cross-sectional view, and FIG. 9C is a front view.

FIG. 10A is a side view, FIG. 10B is a front cross-sectional view, and FIG. 100 is a front view.

FIG. 11A is a side view, FIG. 11B is a front cross-sectional view, and FIG. 11C is a front view.

FIG. 14A is a left-side view, FIG. 14B is a front view, and FIG. 14C is a perspective view.

FIG. 15A is a left-side view, FIG. 15B is a front view, FIG. 15C is a cross-sectional view, and FIG. 15D is a perspective view.

FIGS. 16A to 16I are views in which a sequence of a connecting operation of the discharging device to the refilling device in FIG. 15A to FIG. 15C is illustrated, where FIGS. 16A to 16D illustrate states where the discharging device and the refilling device are seen from the left, FIGS. 16E to 16H are enlarged cross-sectional views of a substantial part of FIGS. 16A to 16D, respectively, and FIG. 16I is a perspective view illustrating a state where the discharging device is connected to the refilling device.

DETAILED DESCRIPTION OF THE INVENTION

[Configuration of Discharge System 10]

Hereinafter, a discharge system 10 according to one embodiment of the present invention is described in detail, referring to the accompanying drawings. Note that although the discharge system 10 of this embodiment has a feature in a structure of a connecting device 140 for connecting a discharging device 20 to a refilling device 100, a structure and an operation of the entire discharge system 10 are first described below, and the structure of the connecting device 140 will then be described in detail.

[Configuration of Entire Discharge System 10]

Figure 1:
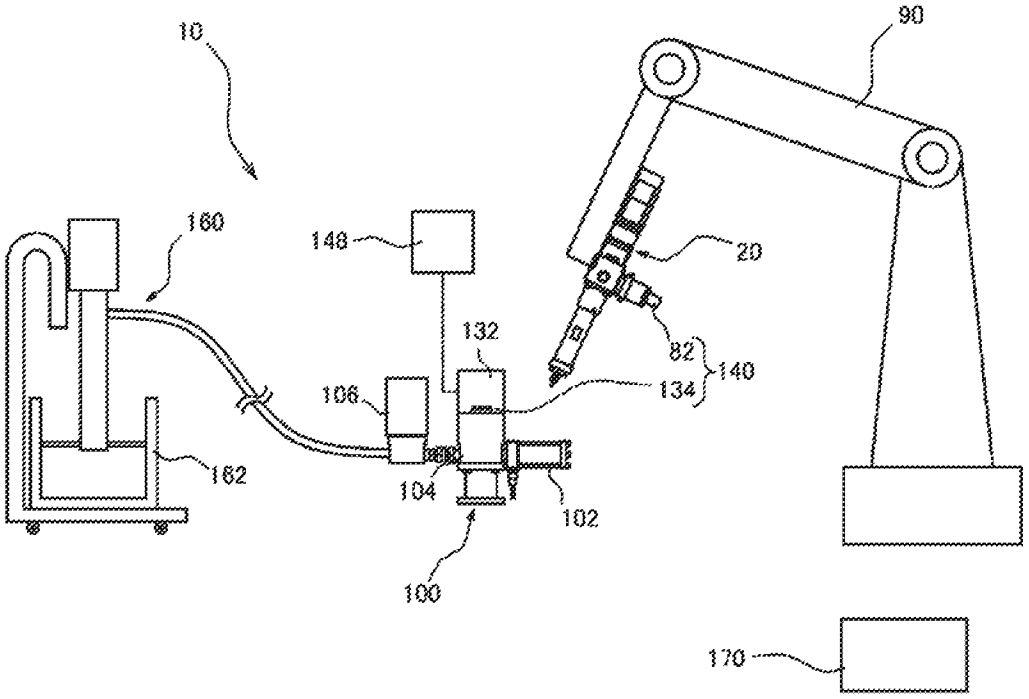
FIG. 1 is a diagram schematically illustrating a discharge system according to one embodiment of the present invention.
Figure 2A:
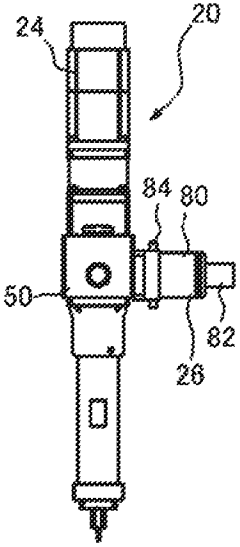
FIGS. 2A to 2E are views illustrating a discharging device which is adopted to the discharge system of FIG. 1, where
Figure 2B:
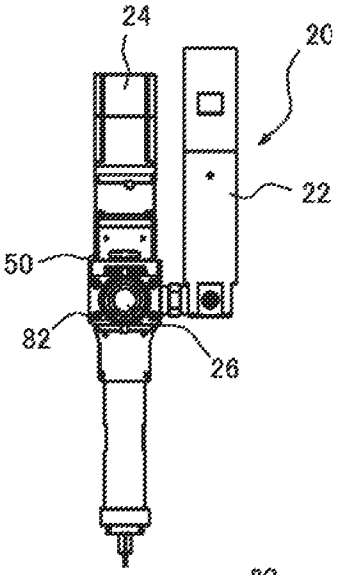
Figure 2C:
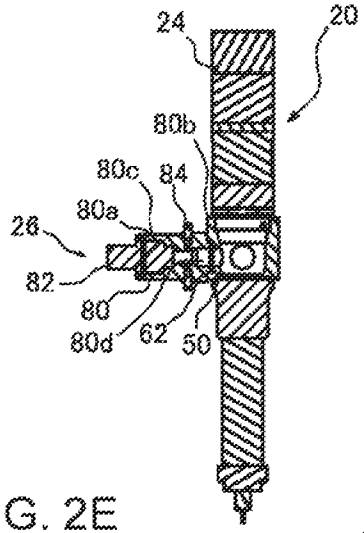
Figure 2D:
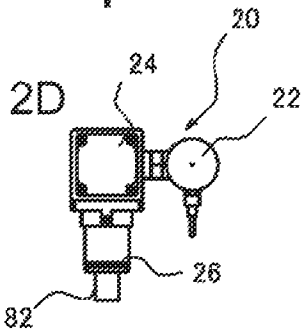
Figure 2E:
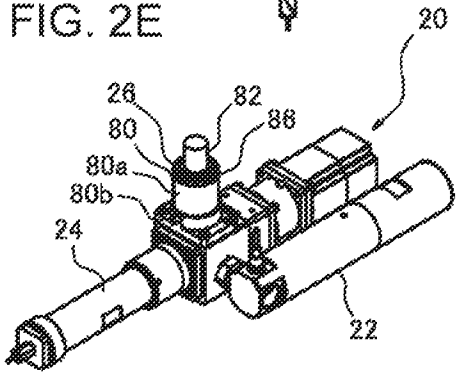
Figures 3A, 3B, 3C, 3D:
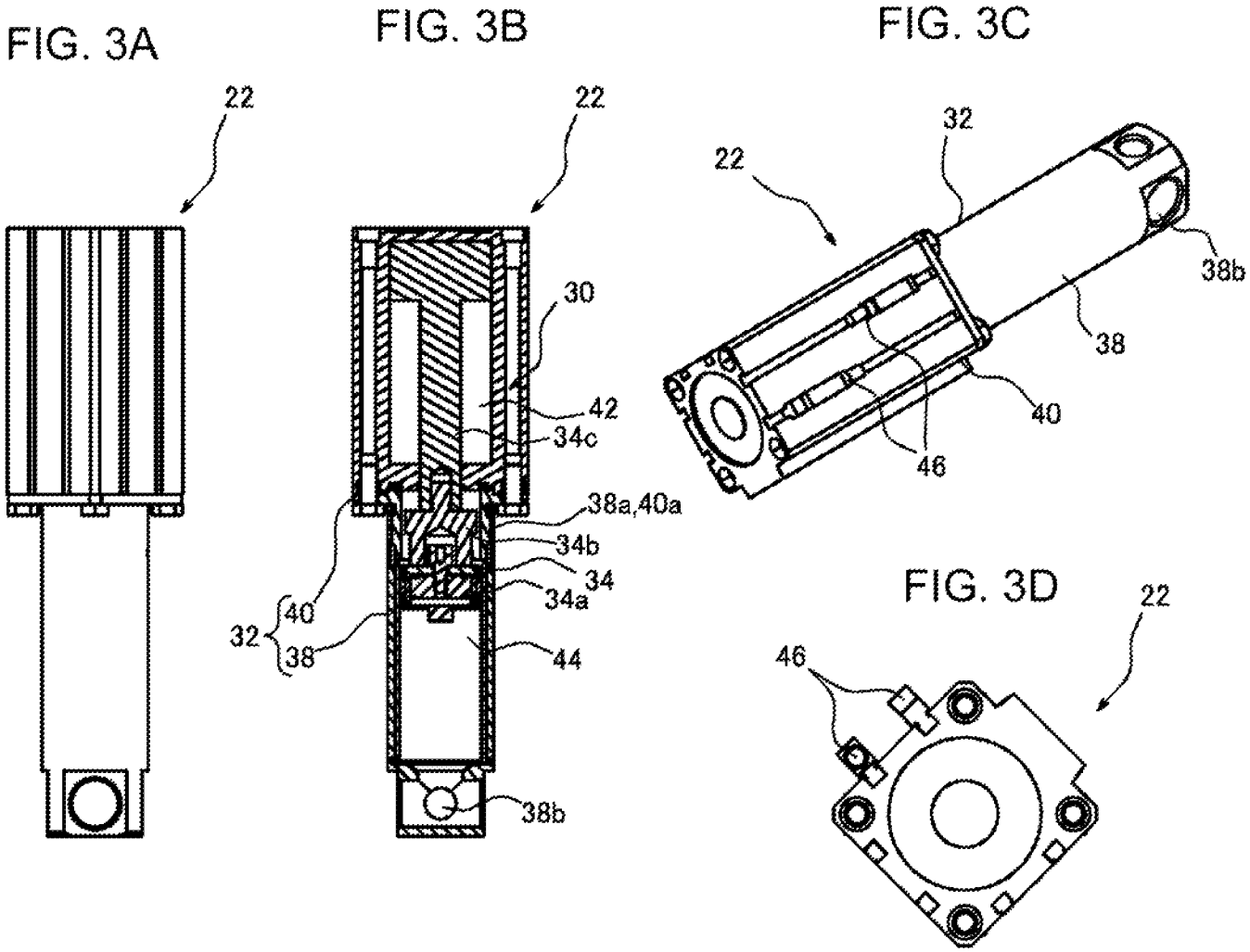
FIGS. 3A to 3D are views illustrating a discharge-side buffer part which is adopted to the discharging device of FIG. 2A to FIG. 2E, where
Figure 4:
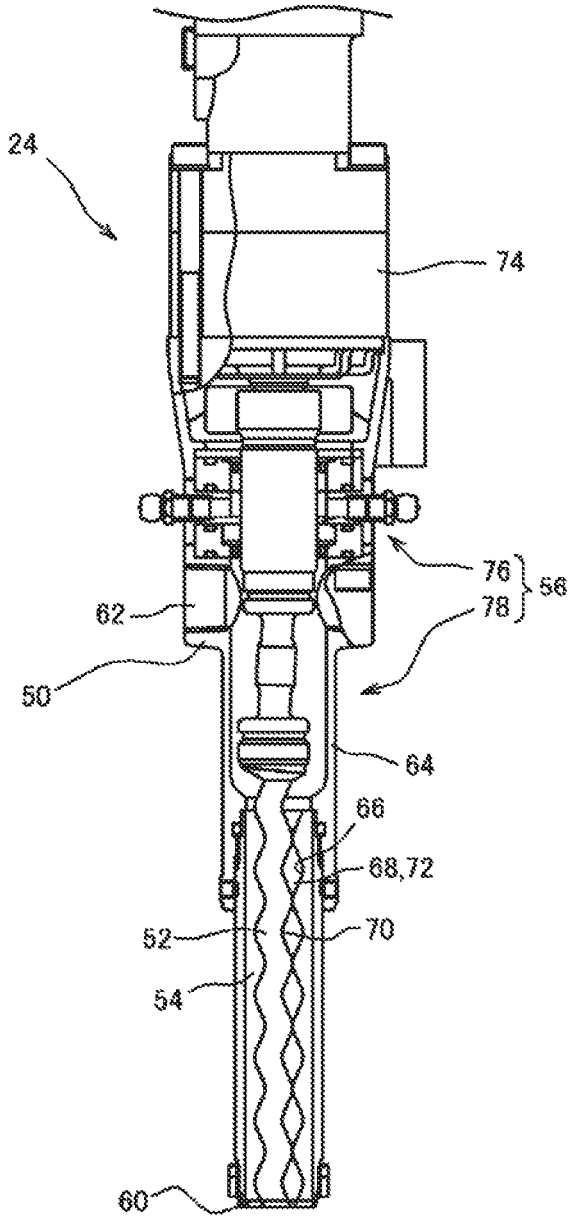
FIG. 4 is a cross-sectional view illustrating a structure of a discharge part adopted to the discharging device of FIG. 2A to FIG. 2E.

As illustrated in FIG. 1, the discharge system 10 includes the discharging device 20, the refilling device 100, a fluid feeder 160, and a controller 170, as primary components. The discharge system 10 is capable of refilling the discharging device 20 with fluid which is supplied from the fluid feeder 160, by connecting the discharging device 20 to the refilling device 100. The discharge system 10 is capable of discharging the refilled fluid for an application purpose etc. by being operated in a state where discharging device 20 is disconnected from the refilling device 100. That is, the discharge system 10 has a system configuration which is capable of applying etc. the fluid by actuating the discharging device 20 independently from the refilling device 100 or the fluid feeder 160 in a state where piping, a hose or the like for fluid supply is not connected to the discharging device 20. As illustrated in FIG. 2A to FIG. E, the discharging device 20 includes a discharge-side buffer part 22 (shock absorber), a discharge part 24, and a discharge-side detachable part 26. The discharge-side buffer part 22 is provided to buffer fluctuation of an internal pressure of the discharging device 20 associated with a connection or disconnection of the discharging device 20 to/from the refilling device 100 in order to refill the discharge part 24 with the fluid for discharge. Although the discharge-side buffer part 22 may be comprised of a container, such as a tank, a component which is provided with a cylinder mechanism 30 as illustrated in FIG. 3A to FIG. 3D is adopted as the discharge-side buffer part 22 in this embodiment. Specifically, as illustrated in FIG. 3B, the discharge-side buffer part 22 includes the cylinder mechanism 30 comprised of a so-called air cylinder. The cylinder mechanism 30 includes a casing 32 and a piston 34. As illustrated in FIG. 3C, the discharge-side buffer part 22 is capable of supplying compressed air from an air supply which is a drive source.

As illustrated in FIG. 3, the casing 32 is a container comprised of a combination of a lower casing 38 and an upper casing 40. A female thread 38*a* and a male thread 40*a* are formed in connecting parts of the lower casing 38 and the upper casing 40, respectively, and the casing 32 is assembled by threadedly engaging the threads. A connecting part 38*b* is provided in a lower end part of the lower casing 38 (opposite from the female thread 38*a*).

The piston 34 is freely slidable inside the casing 32 in axial directions of the casing 32. The piston 34 is constructed by connecting a piston rod 34*c* to a piston body 34*a* via a piston adapter 34*b*. The piston 34 divides a space inside the casing 32 to a first chamber 42 on the upper casing 40 side and a second chamber 44 on the lower casing 38 side. The first chamber 42 is a section where the compressed air supplied from the air supply as the drive source is introduced via a port 46 formed in the casing 32, and the second chamber 44 is a section where the fluid inflows and outflows. The cylinder mechanism 30 varies a capacity of the second chamber 44 by actuating the drive source. The second chamber 44 communicates with the connecting part 38*b*, and the fluid can inflow and outflow into/from the second chamber 44 via the connecting part 38*b*. The discharge-side buffer part 22 is provided with a refilled amount detector (not illustrated) for detecting a refilled amount based on the position of the piston 34. The refilled amount detector may be comprised of any kind of component. Specifically, an auto switch may be adopted as the refilled amount detector, which switches contacts between an ON state and an OFF state as a magnet (not illustrated) provided to the piston 34 enters and leaves into/from a detection range, and the auto switch may be provided at an upper limit position and a lower limit position of a range where the piston 34 is movable, respectively. Alternatively, a pressure sensor which can detect the internal pressure of the discharge-side buffer part 22 may be adopted as the refilled amount detector. In this case, an upper limit and a lower limit of the internal pressure may be determined beforehand, and the piston 34 can be determined to be reached the upper limit position when the internal pressure reaches the upper limit, while the piston 34 can be determined to be reached the upper limit position when the internal pressure reaches the lower limit.

The discharge part 24 is comprised of a rotary displacement pump. In this embodiment, the discharge part 24 is comprised of a so-called uniaxial eccentric screw pump. The discharge part 24 is constructed by accommodating, for example, a rotor 52, a stator 54, and a power transmission mechanism 56 inside a casing 50. The casing 50 is a cylindrical member made of metal, and a first opening 60 is formed at one end side in longitudinal directions. A second opening 62 is formed in the circumference of the casing 50. The second opening 62 communicates with an interior space of the casing 50 at an intermediate part 64 located at an intermediate part of the casing 50 in the longitudinal directions.

The first opening 60 and the second opening 62 function as a suction port and a discharge port, respectively, of the uniaxial eccentric screw pump which forms the discharge part 24. As the discharge part 24 rotates the rotor 52 in a positive direction, the first opening 60 functions as the discharge port and the second opening 62 as the suction port. Contrarily, as the rotor 52 is rotated in the opposite direction for maintenance etc., the first opening 60 functions as the suction port and the second opening 62 as the discharge port, to allow the interior space etc. of the casing 50 to be cleaned.

The stator 54 is a member having the outer shape of a substantially circular cylinder made of an elastic material, such as rubber, or a resin. An inner circumference wall 66 of the stator 54 is formed in a single-twist or multiple-twist female screw shape with n-grooves. In this embodiment, the stator 54 is formed in a multiple twist female screw with two grooves. A penetration bore 68 of the stator 54 is formed in a substantially elongated circle or oval in the cross-sectional shape thereof (aperture shape) even if it is cut at any position in the longitudinal directions of the stator 54.

The rotor 52 is a shaft body made of metal, and is formed in a single-twist or multiple-twist male screw shape with n-1 grooves. In this embodiment, the rotor 52 is formed in an eccentric male screw with one groove. The rotor 52 is formed in a substantially true circle in the cross-sectional shape thereof even if it is cut at any position in the longitudinal directions. The rotor 52 is inserted into the penetration bore 68 formed in the stator 54 described above, and is freely eccentrically rotatable inside the penetration bore 68. As the rotor 52 is inserted into the stator 54, an outer circumference wall 70 of the rotor 52 closely contacts the inner circumference wall 66 of the stator 54 at both the tangent, and thereby fluid carrying paths 72 (cavities) are formed between the inner circumference wall 66 of the stator 54 and the outer circumference wall 70 of the rotor 52. The fluid carrying paths 72 spirally extend in the longitudinal directions of the stator 54 and the rotor 52.

As the rotor 52 is rotated inside the penetration bore 68 of the stator 54, the fluid carrying paths 72 shift in the longitudinal direction of the stator 54 while rotating inside the stator 54. Therefore, when the rotor 52 is rotated, it is possible to suck the fluid into the fluid carrying paths 72 from one end side of the stator 54, and carry this fluid toward the other end side of the stator 54 in a state where the fluid is sealed inside the fluid carrying paths 72, and discharge the fluid from the other end side of the stator 54.

The power transmission mechanism 56 is to transmit power from a drive 74 to the rotor 52 described above. The power transmission mechanism 56 includes a power transmission part 76 and an eccentric rotation part 78. The power transmission part 76 is provided at one end side in the longitudinal directions of the casing 50. The eccentric rotation part 78 is provided to the intermediate part 64. The eccentric rotation part 78 connects the power transmission part 76 with the rotor 52 so that a power transmission therebetween is possible. The eccentric rotation part 78 includes a coupling shaft 98 comprised of a known coupling rod, a screw rod, etc. Thus, the eccentric rotation part 78 actuates the drive 74 to transmit the generated torque to the rotor 52, thereby eccentrically rotating the rotor 52. As illustrated in FIG. 2A to FIG. 2E, the discharge-side detachable part 26 is connected to the casing 50 which forms the discharge part 24 described above. As illustrated in FIGS. 2(*c*) and (*d*), the discharge-side detachable part 26 is constructed by attaching a discharge-side coupler 82 and pins 84 to a discharge-side detachable part main body 80. The discharge-side detachable part main body 80 is constructed by providing a rectangular connecting part 80*b* to a base end part of a circular cylindrical tube part 80*a*. A fitting part 80*c* into which the discharge-side coupler 82 is inserted is formed in a tip end side of the tube part 80*a*. A communicating path 80*d* is formed inside the tube part 80*a* so as to penetrate from the fitting part 80*c* to the connecting part 80*b*. The discharge-side detachable part main body 80 is attached to the casing 50 in a state where it is positioned so that the communicating path 80*d* communicates with the second opening 62 formed in the discharge part 24. A sealing member 86, such as an O-ring, is attached to the circumference on the tip end side of the tube part 80*a*. As will be described later in detail, the discharge-side coupler 82 constitutes the connecting device 140 for connecting the discharging device 20 to the refilling device 100 by a combination with a refill-side coupler 134 provided to the refilling device 100. The discharge-side coupler 82 is a male plug to be inserted into the refill-side coupler 134. The discharge-side coupler 82 is inserted into the fitting part 80*c* provided in the tube part 80*a* of the discharge-side detachable part main body 80, and communicates with the communicating path 80*d*.

The pins 84 constitute a disconnection preventive mechanism 150 by a combination with latch grooves 144 formed on the refilling device 100 side, as will be described later in detail. The pins 84 are used in order to align the discharging device 20 with the refilling device 100 when connecting the discharging device 20 to the refilling device 100, and prevent a disconnection of the discharging device 20 from the refilling device 100. The pins 84 are formed so as to project substantially perpendicular to the circumferential surface of the tube part 80*a*, at positions on the base end side of the tube part 80*a* (connecting part 80*b* side). Two pins 84 are provided to the tube part 80*a*, at an interval of substantially 180° in the circumferential direction.

As illustrated in FIG. 1, the discharging device 20 is attached to a manipulator 90 having a plurality of degrees of freedom, such as a so-called articulated robot. Thus, the fluid is discharged from the discharging device 20 while moving the discharging device 20 by the manipulator 90 to apply the fluid to various components etc. according to a given fluid application pattern. Further, the discharging device 20 is moved etc. by the manipulator 90 in the orders illustrated in FIGS. 9 to 12, and the discharge-side coupler 82 is then brought close to the refill-side coupler 134 described later in detail to align the discharge-side coupler 82 with the refill-side coupler 134 to connect the discharging device 20 with the refilling device 100. The discharging device 20 can be disconnected from the refilling device 100 by performing a reverse operation.

Figure 5:
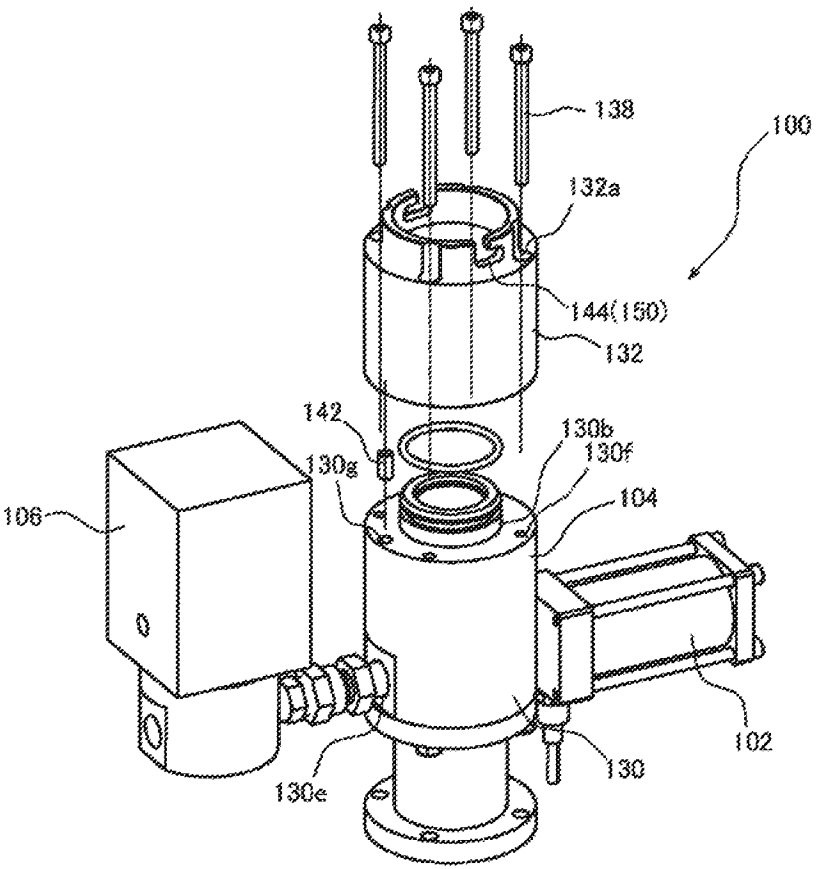
FIG. 5 is an exploded perspective view of a refilling device adopted to the discharge system of FIG. 1.
Figure 6B:
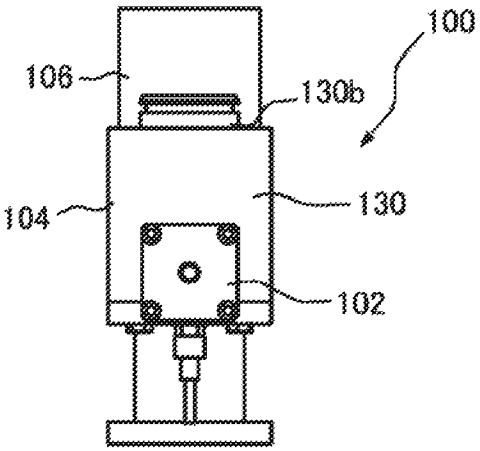
FIGS. 6A to 6D are views illustrating a part other than a sealed space forming body of the refilling device of FIG. 5, where
Figure 6D:
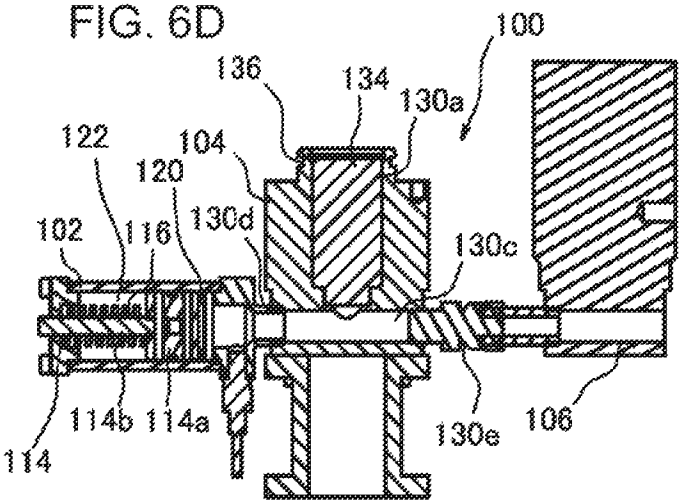
Figure 6A:
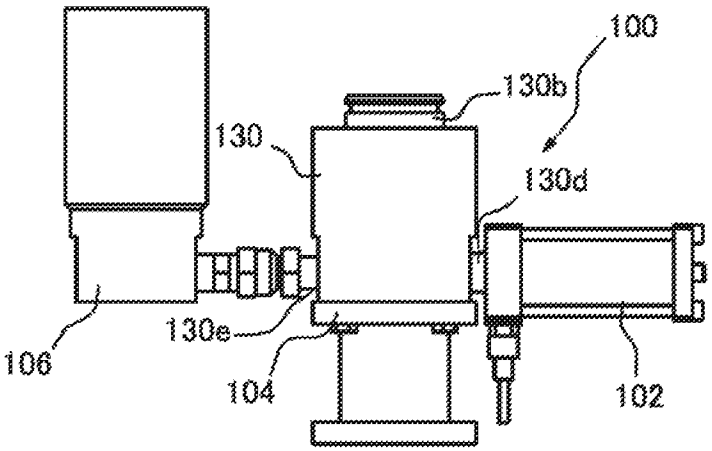
Figure 6C:
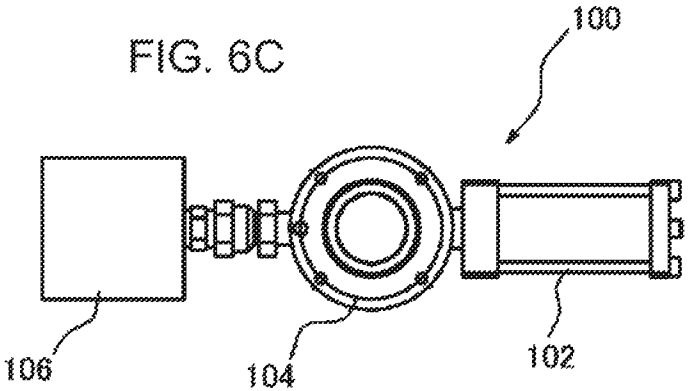

The refilling device 100 functions as a refill station for refilling the discharging device 20 with the fluid. As illustrated in FIGS. 1 and 5, the refilling device 100 includes a refill-side buffer part 102 (shock absorber), a refill-side detachable part 104, and a valve 106. The refill-side buffer part 102 is provided to buffer an internal pressure fluctuation of the refilling device 100 associated with a connection and disconnection of the discharging device 20 to/from the refilling device 100 when refilling the discharge part 24 with the fluid. Although the refill-side buffer part 102 may be comprised of a container, such as a tank, or the cylinder mechanism 30 similar to the discharge-side buffer part 22 described above, the refill-side buffer part 102 is comprised of an absorber mechanism 110 in this embodiment as illustrated in FIG. 6D.

Specifically, the absorber mechanism 110 includes a casing 112, a piston 114, and a spring 116, and is operated using an elastic force of the spring 116. The casing 112 is a circular cylindrical tube body and has a connecting part 118 on one end side in axial directions thereof. The piston 114 is freely slidable inside the casing 112 in the axial directions. The piston 114 is constructed by connecting a piston rod 114*b* to a piston body 114*a*. An interior space of the casing 112 is divided via the piston body 114*a* into a first chamber 120 on one side and a second chamber 122 which communicates with the connecting part 118 on the other side. The spring 116 is provided inside the second chamber 122. Thus, the piston body 114*a* is biased toward the first chamber 120. When the fluid inflows via the connecting part 118, the piston body 114*a* is pushed back toward the second chamber 122 against the biasing force of the spring 116, thereby expanding the first chamber 120.

As illustrated in FIG. 5, the refill-side detachable part 104 is constructed by integrally connecting a sealed space forming body 132 to a refill-side detachable part main body 130. As illustrated in FIG. 5(*d*), the refill-side detachable part main body 130 has a hollow fitting part 130*a*, and is provided with a connecting part 130*b* formed so as to be continuous from the fitting part 130*a* and project on the top side. The refill-side coupler 134 described later in detail is integrally inserted into the fitting part 130*a*. A sealing member 136, such as an O-ring is attached to the circumference of the connecting part 130*b*. The refill-side detachable part main body 130 has a communicating path 130*c* formed so as to communicate with the fitting part 130*a*. Connection ports 130*d* and 130*e* are formed at both ends of the communicating path 130*c*. The connecting part 118 of the refill-side buffer part 102 is plumbed to the connection port 130*d*. The valve 106 is plumbed to the connection port 130*e*. The refill-side coupler 134 constitutes the connecting device 140 for connecting the discharging device 20 to the refilling device 100 by a combination with the discharge-side coupler 82 provided on the discharging device 20 side. The refill-side coupler 134 is a female socket into which the discharge-side coupler 82 is inserted. As the refill-side coupler 134, one provided therein with a valve mechanism (not illustrated), such as a stop valve mechanism, may be used, for example. The refill-side coupler 134 is integrally fitted into the fitting part 130*a* of the refill-side detachable part main body 130, thereby communicating with the communicating path 130*c* formed in the refill-side detachable part main body 130.

As illustrated in FIG. 5, the sealed space forming body 132 is a cylindrical member which is detachably connected to the top side of the refill-side detachable part main body 130 described above. Specifically, the sealed space forming body 132 becomes integral with the refill-side detachable part main body 130 by inserting bolts 138 into a plurality of bolt insertion holes 132*a* (four in this embodiment) formed in the circumferential direction so as to extend in the axial directions, and fastening the bolts 138 with the threaded holes 130*f* formed in the top of the refill-side detachable part main body 130. Upon the integration of the refill-side detachable part main body 130 and the sealed space forming body 132, a positioning pin 142 is attached to a pin hole (not illustrated) formed in the bottom of the sealed space forming body 132 (refill-side detachable part main body 130 side) and a pin hole 130*g* formed at the top side of the refill-side detachable part main body 130. Thus, the refill-side detachable part main body 130 is connected to the sealed space forming body 132 so that they have a certain spatially aligned relationship therebetween in the circumferential direction. A gap between the refill-side detachable part main body 130 and the sealed space forming body 132 is sealed with the sealing member 136 attached to the circumference of the connecting part 130*b*.

The latch grooves 144 are formed in a top part of the cylinder body (end part opposite from the refill-side detachable part main body 130) which forms the sealed space forming body 132. The latch grooves 144 constitute the disconnection preventive mechanism 150 by a combination with the pins 84 provided on the discharging device 20 side. The disconnection preventive mechanism 150 holds the discharging device 20 and the refilling device 100 with a force which acts when refilling the fluid from the refilling device 100 toward the discharging device 20, so that the discharging device 20 is not disconnected from the refilling device 100. Specifically, each latch groove 144 is a slit having a substantially L-shape in the front view, and has a slit portion which opens toward the top of the sealed space forming body 132, and another slit portion which continues from the first slit portion so as to extend in the circumferential direction of the sealed space forming body 132. Thus, in the state where the pins 84 provided to the discharge-side detachable part 26 of the discharging device 20 are aligned with the latch grooves 144, the discharge-side detachable part 26 is inserted into the sealed space forming body 132 and is rotated in the circumferential direction to engage the pins 84 with the latch grooves 144 so that the pins 84 are not disengaged from the latch grooves 144.

An exhaust port (not illustrated) is formed in the circumference of the sealed space forming body 132. The exhaust port is connected to the sealed space forming body 132 so as to communicate the inside of the sealed space forming body 132 with the outside. As illustrated in FIG. 1, the sealed space forming body 132 is connected via the exhaust port to a decompressor 148, such as a vacuum pump.

The fluid feeder 160 pumps up the fluid from a storage tub 162 where the fluid is stored, and feeds the fluid to the refilling device 100. The fluid feeder 160 is plumbed to the valve 106 provided to the refilling device 100. Thus, a control of supplying the fluid to the refilling device 100 is carried out by suitably opening and closing the valve 106.

The controller 170 performs an operational control of each component, such as the discharging device 20, the manipulator 90, the refilling device 100, and the fluid feeder 160, which constitute the discharge system 10. The controller 170 controls operations, such as a discharge operation of the fluid from the discharging device 20, an operation of the manipulator 90, and a refill operation of the fluid which is carried out primarily by the discharging device 20 and the refilling device 100.

[Operation of Discharge System 10]

Figure 7:
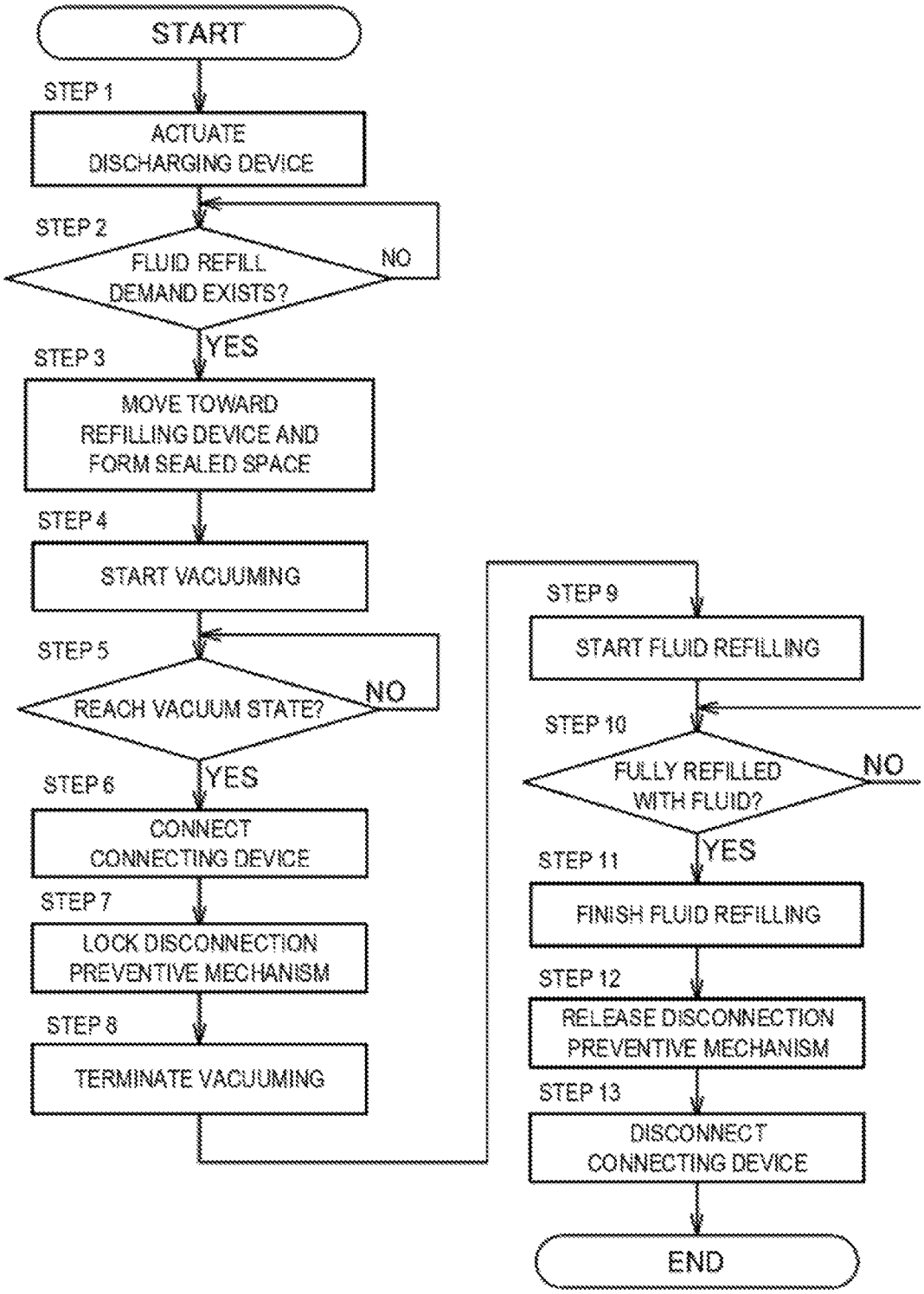
FIG. 7 is a flowchart illustrating an operation of the discharge system of FIG. 1.
Figure 8:
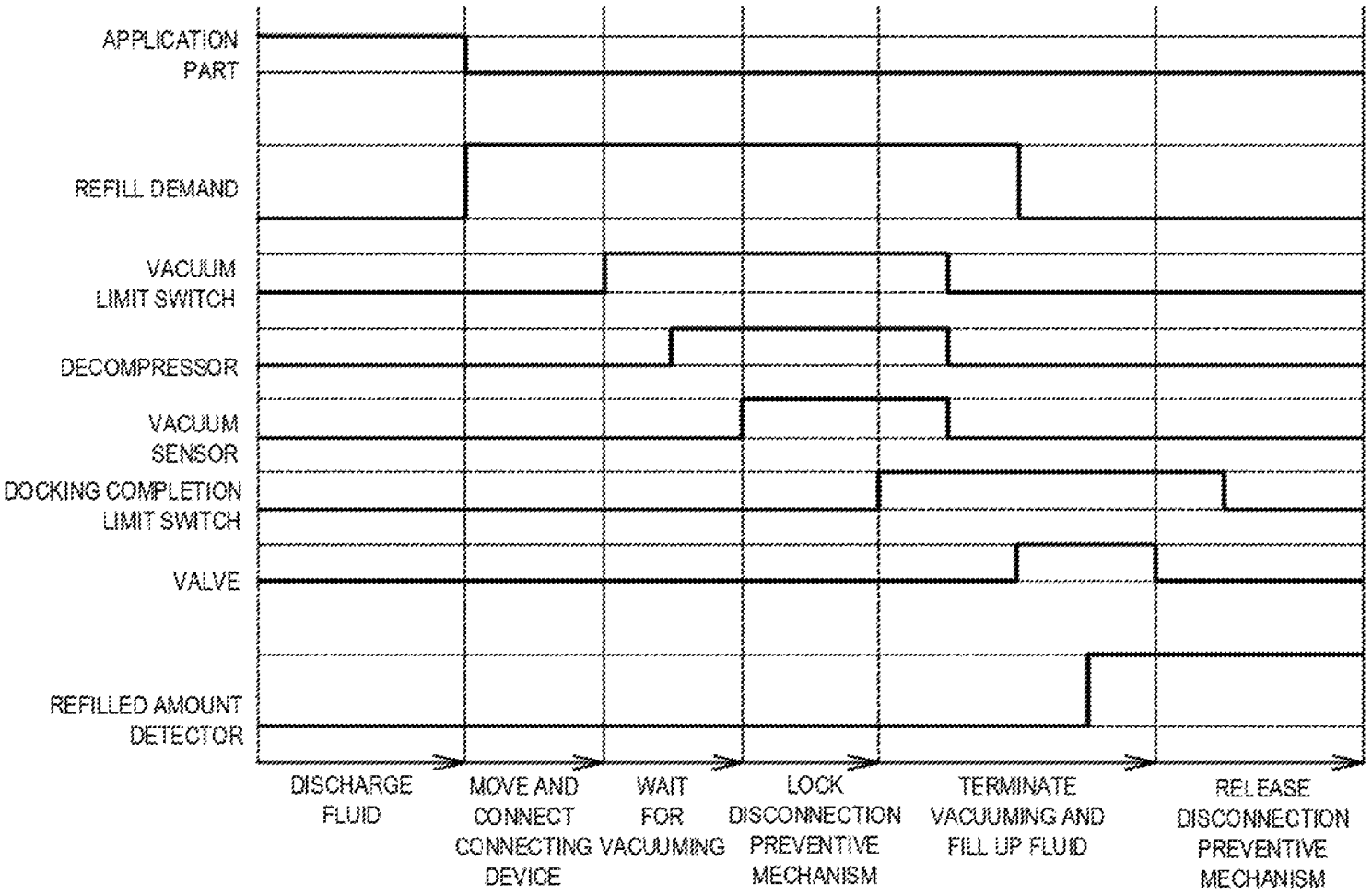
FIG. 8 is a timing chart illustrating the operation of the discharge system of FIG. 1.

Below, the operation of the discharge system 10 described above, particularly, the refill operation of the discharging device 20 with the fluid is primarily described referring to a flowchart illustrated in FIG. 7 and a timing chart illustrated in FIG. 8. In the discharge system 10, the discharging device 20 is actuated at Step 1, where the discharge operation of the fluid is carried out. After the operation of the discharging device 20, when the controller 170 determines at Step 2 that a demand of refilling the discharging device 20 with the fluid is outputted, the control flow transits to Step 3. Here, the determination of the existence of the demand of refilling the discharging device 20 with the fluid may be carried out based on various criteria. For example, when a pressure sensor (not illustrated) for detecting the internal pressure of the discharge-side buffer part 22 provided to the discharging device 20 detects a pressure below a given value, it may be determined that the piston 34 reaches the lower limit position inside the discharge-side buffer part 22, and the refill demand of the fluid is turned into an ON state. Alternatively, if the auto switch which turns on and off according to the position of the piston 34 is adopted as the refilled amount detector, it may be determined that the refill demand of the fluid is turned on when the piston 34 is determined to be reached the lower limit position based on the detection result of the auto switch.

Figure 9A:
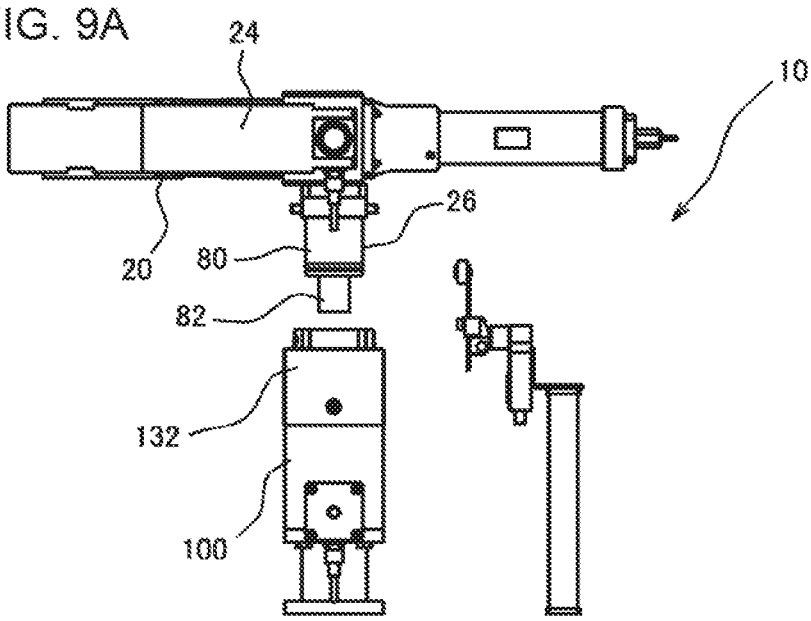
FIGS. 9A to 9C are views illustrating a first stage of the operation according to the discharge system of FIG. 1, where
Figure 9B:
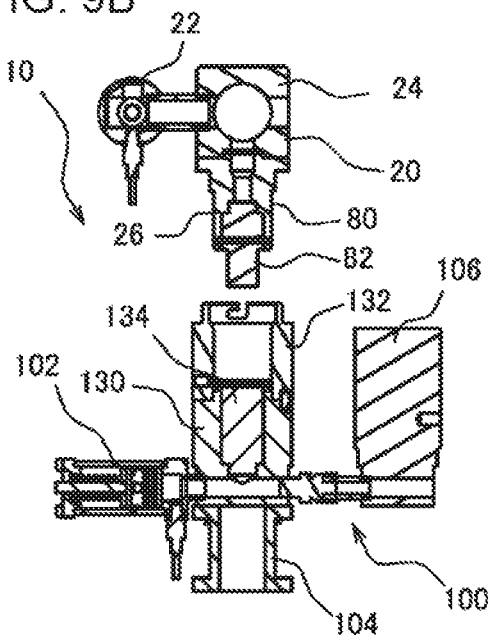
Figure 9C:
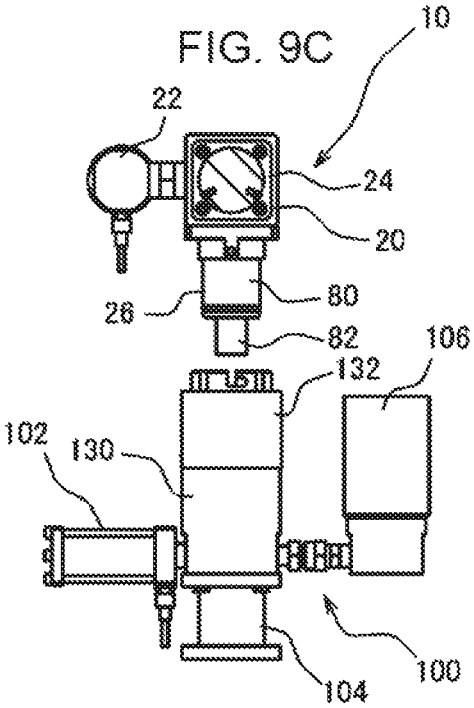
Figure 10A:
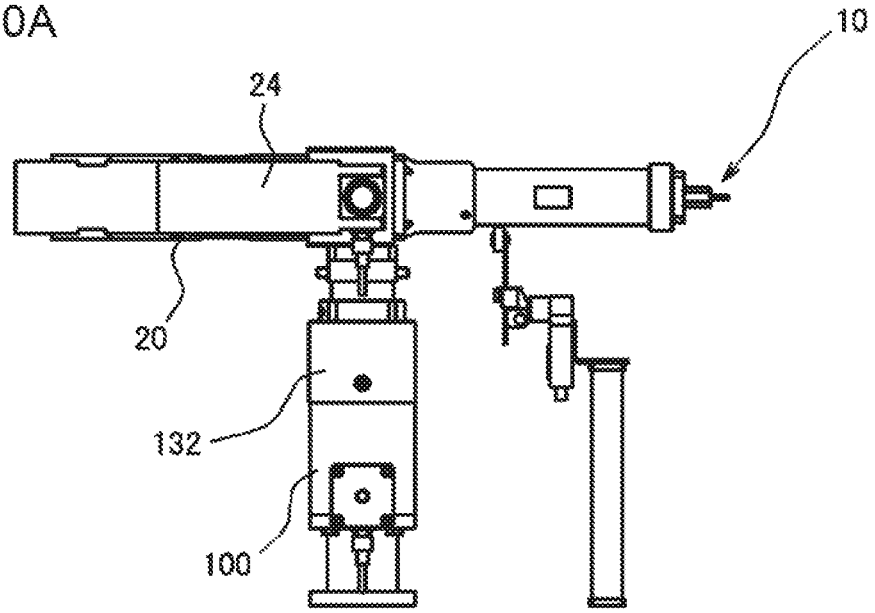
FIGS. 10A to 10C are views illustrating a second stage of the operation according to the discharge system of FIG. 1, where
Figure 10B:
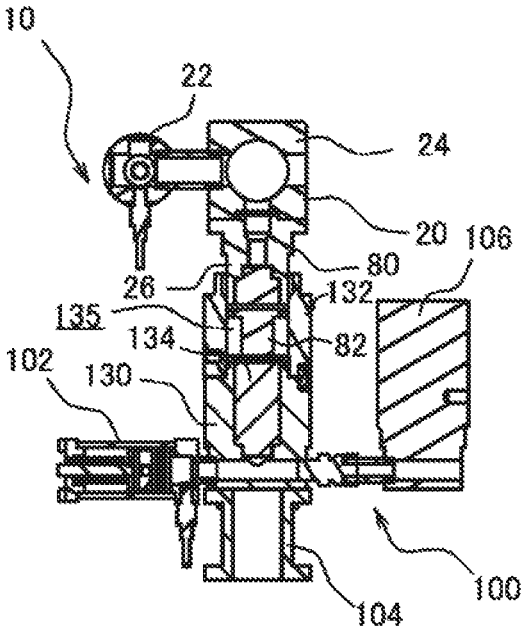
Figure 10C:
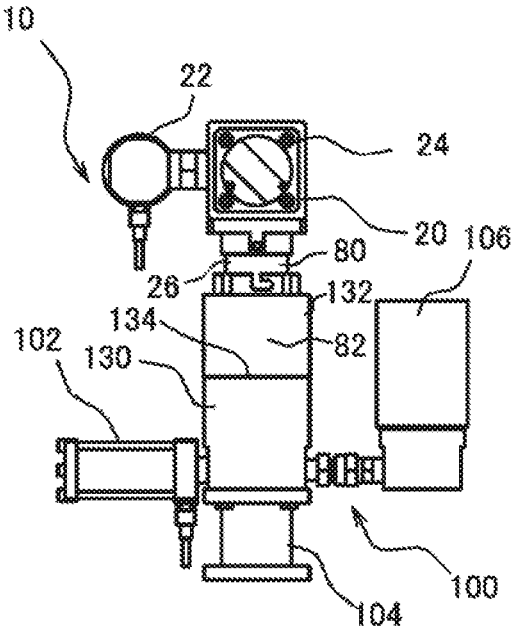
Figure 13:
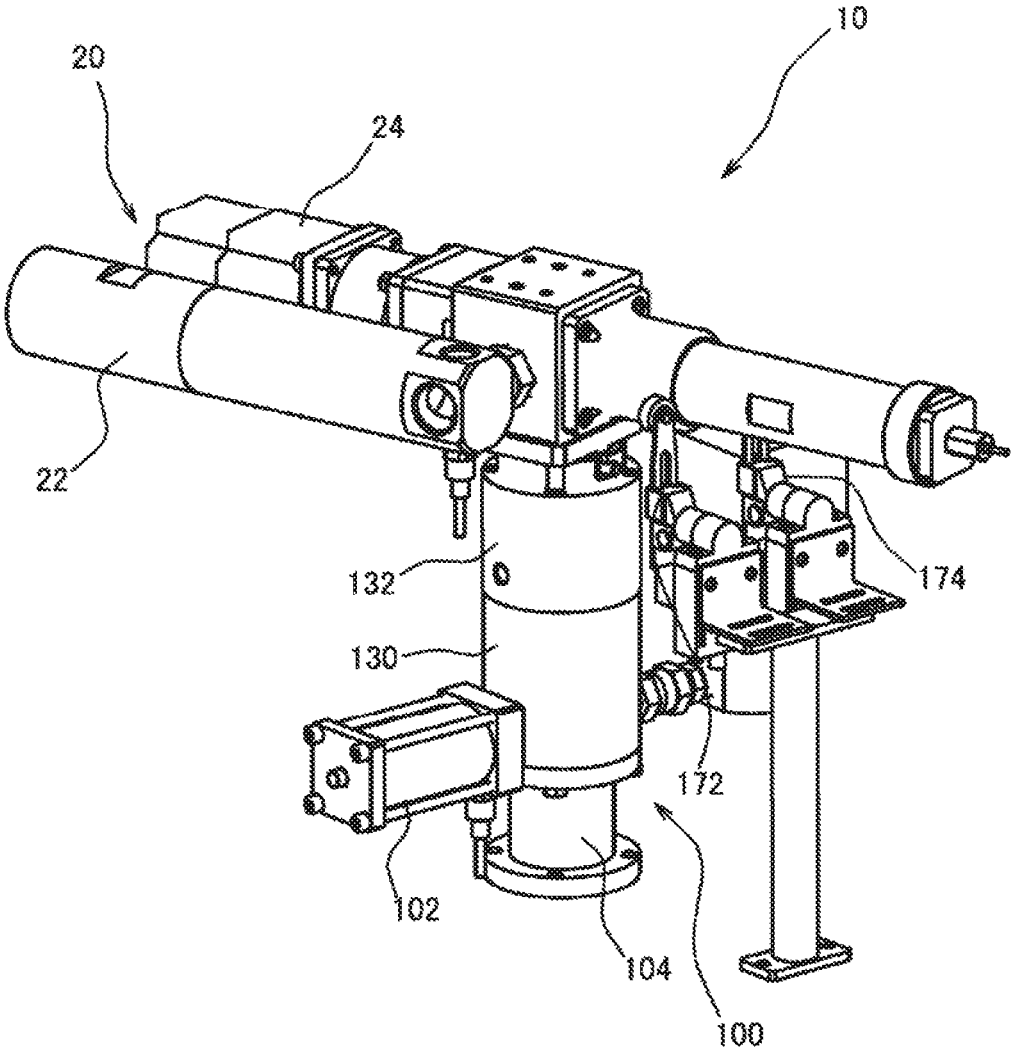
FIG. 13 is a perspective view illustrating a state where the discharging device is connected to the refilling device, in the discharge system of FIG. 1.

If it is determined that the fluid refill demand exists at Step 2 and the control flow transits to Step 3, the discharging device 20 is moved toward the refilling device 100 by the manipulator 90 as illustrated in FIG. 9A to FIG. 9C. Then, as illustrated in FIG. 10A to FIG. 100, the tube part 80*a* of the discharge-side detachable part main body 80 provided on the discharging device 20 side is inserted from the top of the cylindrical sealed space forming body 132 provided on the refilling device 100 side. In this stage (Step 3), as illustrated in FIG. 10B, it is a state where the discharge-side coupler 82 on the discharging device 20 side is not connected to the refill-side coupler 134. In this state, the gap between the outer circumferential surface of the tube part 80*a* and the inner circumferential surface of the sealed space forming body 132 is sealed with the sealing member 86 attached to the circumference of the tube part 80*a*, at the top side of the sealed space forming body 132. On the other hand, at the bottom side of the sealed space forming body 132, the gap between the outer circumferential surface of the connecting part 130*b* and the inner circumferential surface of the sealed space forming body 132 is sealed with the sealing member 136 attached to the circumference of the connecting part 130*b*. Therefore, in the state of Step 3, a sealed space 135 is formed inside the sealed space forming body 132, and the discharge-side coupler 82 and the refill-side coupler 134 are disposed in a non-connected state within the sealed space 135. When the sealed space 135 is formed inside the sealed space forming body 132 as described above, the control flow transits to Step 4. At Step 4, the decompressor 148 plumbed to the discharge port 146 of the sealed space forming body 132 is actuated to start vacuuming in order to make the sealed space 135 substantially vacuum. Note that a detection of the connected state between the tube part 80*a* and the sealed space forming body 132 which is a trigger of starting the vacuuming may be implemented in various methods. Specifically, a vacuum limit switch 172 for detecting that the tube part 80*a* is inserted into the sealed space forming body 132 may be provided at a position adjacent to the refilling device 100 as illustrated in FIG. 13. Based on a signal outputted from the vacuum limit switch 172, the controller 170 may determine that the tube part 80*a* is inserted into the sealed space forming body 132, and the sealed space 135 is formed.

Figure 11A:
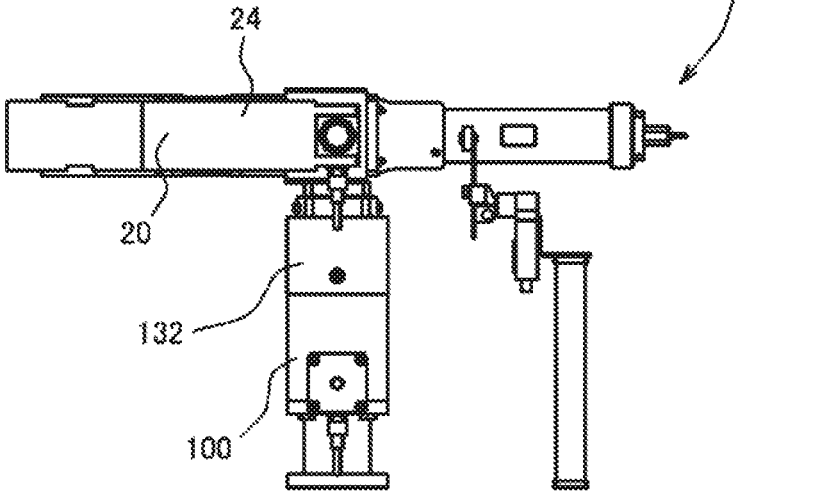
FIGS. 11A to 11C are views illustrating a third stage of the operation according to the discharge system of FIG. 1, where
Figure 11B:
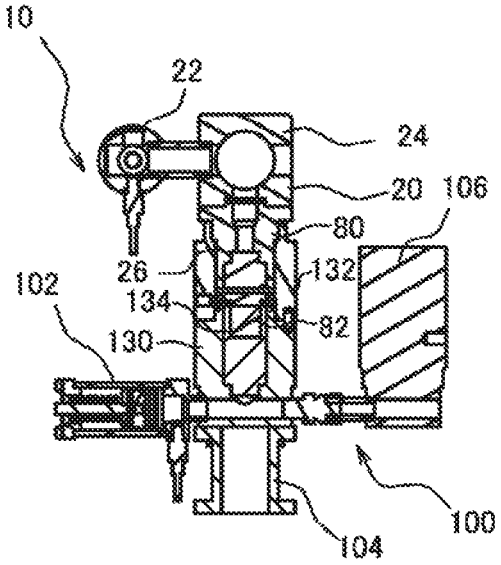
Figure 11C:
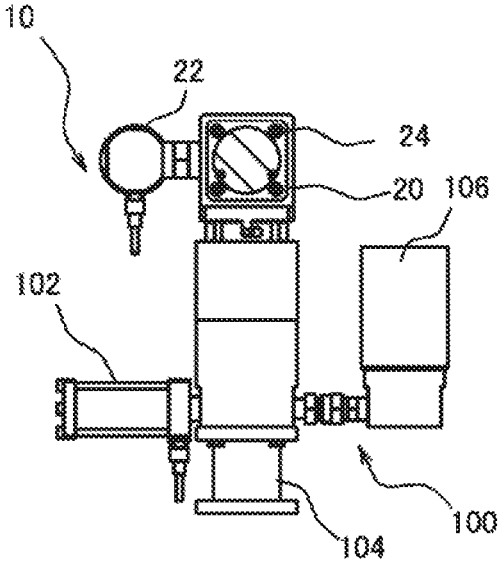

After the vacuuming is started at Step 4, when a vacuum sensor (not illustrated) for detecting a degree of vacuum of the sealed space 135 confirms at Step 5 that the degree of vacuum reaches a target value, the control flow transits to Step 6. At Step 6, the controller 170 controls the operation of the manipulator 90 so that the discharging device 20 moves in the axial direction of the discharge-side coupler 82 to approach the refilling device 100. Here, the controller 170 outputs to the manipulator 90 a signal which controls an operating speed of the discharging device 20 (operating speed control signal) so that the discharging device 20 approaches the refilling device 100 at a given speed V1. Thus, as illustrated in FIG. 11A to FIG. 11C, within the sealed space 135, the discharge-side coupler 82 approaches the refill-side coupler 134 at the speed V1, and both the couplers 82 and 134 (connecting device 140) becomes in the connected state.

Figure 12E:
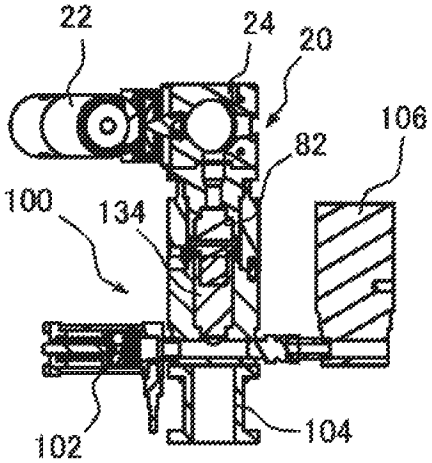
FIG. 12E and FIG. 12F are cross-sectional views illustrating the fourth stage and the fifth stage of the operation, respectively.
Figure 12C:
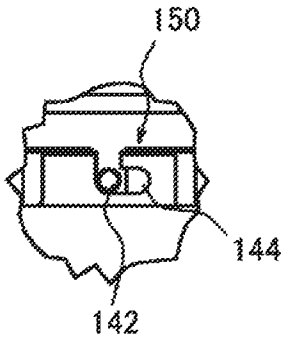
FIG. 12C and FIG. 12D are enlarged views illustrating states of a disconnection preventive mechanism in the fourth stage and the fifth stage of the operation, respectively.
Figure 12A:
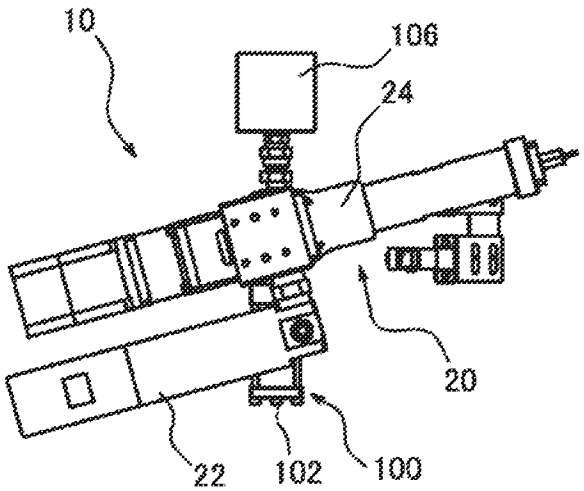
FIGS. 12A to 12B are plan views illustrating a fourth stage and a fifth stage of the operation according to the discharge system of FIG. 1, respectively.
Figure 12F:
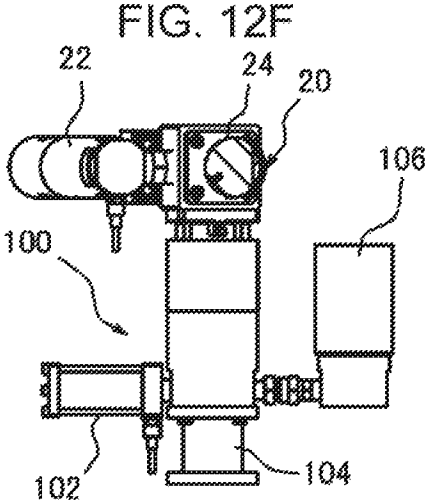
Figure 12D:
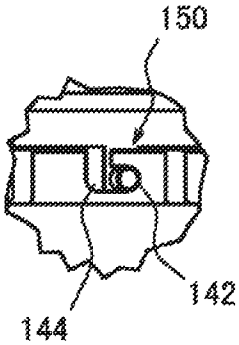
Figure 12B:
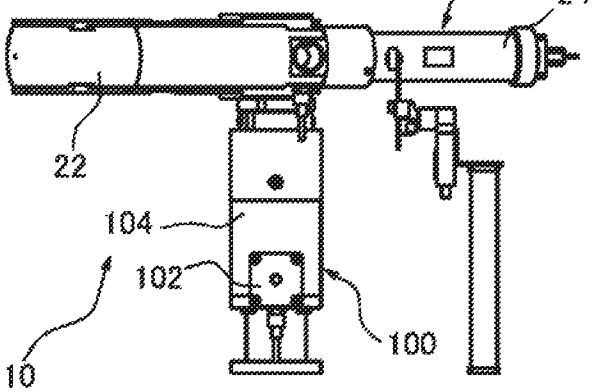

When the connecting device 140 becomes in the connected state, the disconnection preventive mechanism 150 is locked at Step 7. Specifically, when the discharge-side coupler 82 is connected to the refill-side coupler 134 at Step 6, the pins 84 provided in the circumference of the discharge-side detachable part main body 80 also move in the axial direction of the sealed space forming body 132, and enter into the latch grooves 144 formed in the sealed space forming body 132, as illustrated in FIG. 12C. At Step 7, when the manipulator 90 turns the discharging device 20 in the circumferential direction of the sealed space forming body 132 as illustrated by an arrow in FIG. 12A, the discharging device 20 is rotated as illustrated in FIG. 12B, and the pins 84 move along the latch grooves 144 and engage with the latch grooves 144 as illustrated in FIG. 12D. Thus, the disconnection preventive mechanism 150 is locked, and the discharging device 20 is connected with the refilling device 100. The detection of the pins 84 reached near the ends of the latch grooves 144 and the disconnection preventive mechanism 150 being locked may be carried out in various methods. Specifically, as illustrated in FIG. 13, a docking completion limit switch 174 (connected state detector) may be provided at a position adjacent to the refilling device 100, which detects that the discharging device 20 is rotated to the position where the pins 84 reaches near the end of the latch groove 144. Based on a signal outputted from the docking completion limit switch 174, it may be detected whether the discharging device 20 is connected to the refilling device 100 and the disconnection preventive mechanism 150 is locked.

When the connection of the connecting device 140 is finished as described above and the disconnection preventive mechanism 150 is locked, the decompressor 148 is stopped at Step 8 to terminate the vacuuming. Then, the control flow transits to Step 9, where the refill of the discharging device 20 with the fluid from the refilling device 100 is started. Specifically, at Step 9, the valve 106 provided to the refilling device 100 is opened, and the fluid fed from the fluid feeder 160 is then fed to the discharging device 20 side via the connecting device 140 comprised of the discharge-side coupler 80 and the refill-side coupler 134. That is, in this embodiment, the valve 106 is opened based on one criterion in which the connection of the discharging device 20 to the refilling device is detected by the docking completion limit switch at Step 7 described above, and based on another criterion in which the vacuuming at Step 8 is finished. The fluid fed to the discharging device 20 side is refilled inside the casing 50 of the discharge part 24 via the discharge-side detachable part 26. Here, as described above, the discharge-side buffer part 22 and the refill-side buffer part 102 are provided to the discharging device 20 and the refilling device 100, respectively. Thus, the internal pressure fluctuation associated with the refilling of the discharging device 20 with the fluid from the refilling device 100 can be buffered, and the internal pressures of the discharging device 20 and the refilling device 100 are maintained at a low pressure near atmospheric pressure. When the refill of the fluid is started as described above, the control flow transits to Step 10, and the controller 170 then determines whether the discharging device 20 side is filled up. Here, various methods for detecting the discharging device 20 being sufficiently or fully refilled with the fluid may be adopted. Specifically, the fluid being sufficiently or fully refilled and the refill demand being turned off may be determined based on a criterion in which the pressure sensor (not illustrated) for detecting the internal pressure of the discharge-side buffer part 22 of the discharging device 20 detects a pressure more than a given value. Further, if the auto switch which turns on and off according to the position of the piston 34 is adopted to the refilled amount detector, the fluid refill demand may be determined to be turned off when the piston 34 reaches the detection range of the auto switch provided at an upper limit position and the auto switch at the upper limit position is then turned on. At Step 10, if it is confirmed that the fluid is filled up in the discharging device 20, the control flow transits to Step 11, where the valve 106 is closed. Thus, the refill of the discharging device 20 with the fluid from the refilling device 100 is finished. Thus, when the refill of the fluid is finished, the control flow transits to Step 12, where the disconnection preventive mechanism 150 is released. Specifically, the manipulator 90 is actuated to turn the discharging device 20 in the direction opposite from the case where the disconnection preventive mechanism 150 is locked at Step 7, and the discharging device 20 is disconnected or separated from the refilling device 100 in the axial direction. Thus, when the pins 84 are released from the latch grooves 144, the disconnection preventive mechanism 150 is unlocked.

When the unlock of the disconnection preventive mechanism 150 is finished, the control flow then transits to Step 13. At Step 13, the discharging device 20 further moves in the direction separating from the refilling device 100 in the axial direction. Here, the controller 170 outputs to the manipulator 90 the signal (operating speed control signal) for controlling the operating speed so that the discharging device 20 separates from the refilling device 100 at a given speed V2. This separating or disconnecting speed V2 is equal to or blow the connecting speed V1 at Step 6 described above ($|V1| \geq |V2|$). Thus, the discharge-side coupler 82 separates from the refill-side coupler 134 at the speed V2 equal to or below the speed at the time of connecting operation, and the discharge-side coupler 82 escapes from the refill-side coupler 134 to be disconnected therefrom. Thereby, the sequence of operational flow is finished. [Detailed Structure of Connecting Device 140]

The connecting device 140 is comprised of the combination of the discharge-side coupler 82 and the refill-side coupler 134 as described above. Below, each structure of the discharge-side coupler 82 and the refill-side coupler 134 which form the connecting device 140 are described, and the size of a clearance formed therebetween is then described.

Figure 17A:
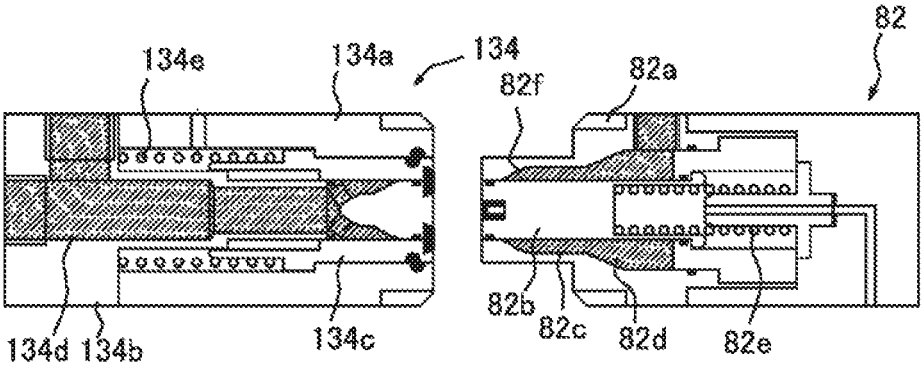
FIGS. 17A to 17C are cross-sectional views of one example of a discharge-side coupler and a refill-side coupler, illustrating an operation of a connecting process.
Figure 17B:
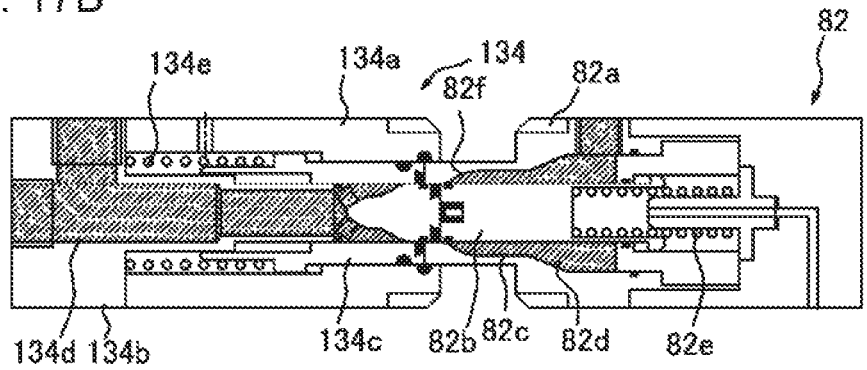
Figure 17C:
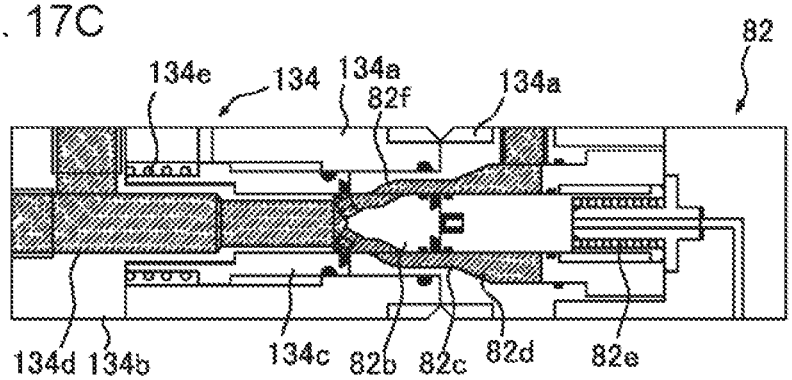

As illustrated in FIG. 17A to FIG. 17C, the discharge-side coupler 82 has a piston part 82*b* (operating part) which is slidable in the axial direction inside a cylinder part 82*a*. The cylinder part 82*a* is formed so as to be convex in cross section toward a tip end side in the axial direction, and has an inserting part 82*f* at the tip end side thereof. A recess 82*d*, which constitutes a channel 82*c* between an inner circumferential side of the cylinder part 82*a* and an outer circumferential surface of the piston part 82*b*, is formed in the inner circumferential side of the cylinder part 82*a*. The channel 82*c* communicates with the communicating path 80*d*. The piston part 82*b* is biased by a spring 82*e* toward the tip end side in the axial direction of the cylinder part 82*a*. When a pressing force acts on the piston part 82*b* in a direction opposite from the biasing direction of the spring 82*e*, the piston part 82*b* slides toward a base end side in the axial direction to open and close the channel 82*c*. The piston part 82*b* operates at locations separated from the passage 82*c* rather than operates inside the passage 82*c*. Thus, even when the piston part 82*b* slides in the axial direction to open and close the channel 82*c*, the capacity of the channel 82*c* does not change. A socket as illustrated in FIG. 17A to FIG. 17C is adopted as the refill-side coupler 134. More specifically, the refill-side coupler 134 includes a cylinder part 134*a*, a channel forming part 134*b*, and a piston part 134*c* (operating part) which is slidable in the axial direction. The cylinder part 134*a* is a cylindrical member and has a diameter of an aperture into which the inserting part 82*f* of the discharge-side coupler 82 described above can be inserted. The channel forming part 134*b* is arranged substantially coaxial with the cylinder part 134*a*. A channel 134*d* is formed inside the channel forming part 134*b*. In a state where the refill-side coupler 134 is inserted into the fitting part 130*a*, the channel 134*d* communicates with the communicating path 130*c*. A terminal part of the channel 134*d* (end opposite from the connecting side with the communicating path 130*c*) has an opening in an external surface of the channel forming part 134*b*. The piston part 134*c* is arranged substantially coaxial with the cylinder part 134*a* and the channel forming part 134*b*. The piston part 134*c* is slidable along the surface of the channel forming part 134*b*. The piston part 134*c* is biased by a spring 134*e* toward a tip end side in the axial direction of the cylinder part 134*a* and the channel forming part 134*b*. Thus, the opening at the terminal part of the channel 134*d* formed in the channel forming part 134*b* is normally closed by an inner circumferential surface of the piston part. On the other hand, when a pressing force acts to the piston part 134*c* in a direction opposite from the biasing direction of the spring 134*e*, the piston part 134*c* slides toward the base end side in the axial direction.

The refill-side coupler 134 moves the piston part 134*c* to the base end side from the terminal opening of the channel 134*d* against the biasing force of the spring 134*e* to open the channel 134*d*. When the piston part 134*c* moves to the tip end side by the biasing force, the channel 134*d* is closed. The piston part 134*c* operates at locations separated from the passage 134*d* rather than operates inside the passage 134*d*. Thus, even when the piston part 134*c* slides in the axial direction to open and close the channel 134*d*, the capacity of the channel 134*d* does not change. As the discharge-side coupler 82 is inserted into the discharge-side coupler 82, the discharge-side coupler 82 is connected to the refill-side coupler 134 so that the channels 82*c* and 134*d* communicate with each other. Specifically, when connecting the discharge-side coupler 82 to the refill-side coupler 134, the inserting part 82*f* of the discharge-side coupler 82 is inserted into the cylinder part 134*a* of the refill-side coupler 134. Here, as illustrated in FIG. 17B, the piston part 134*c* on the refill-side coupler 134 side is pushed in by the inserting part 82*f*. Accordingly, the piston part 134*c* slides in a direction opposite from the biasing direction of the spring 134*e*. On the other hand, the piston part 82*b* provided to the discharge-side coupler 82 side is pressed in the axial direction by the tip end part of the channel forming part 134*b* on the refill-side coupler 134 side. Thus, the piston part 82*b* slides in a direction opposite from the biasing direction of the spring 82*e*. When the operation of inserting the inserting part 82*f* of the discharge-side coupler 82 into the cylinder part 134*a* of the refill-side coupler 134 as described above is continued, the terminal openings of the channels 82*c* and 134*d* which are closed by the piston parts 82*b* and 134*c* are opened so that the channels 82*c* and 134*d* communicate with each other, as illustrated in FIG. 17C. Thus, although the piston parts 82*b* and 134*c* operate during the process where the discharge-side coupler 82 is connected to the refill-side coupler 134, the capacities of the channels 82*c* and 134*d* do not fluctuate. Also when the discharge-side coupler 82 is separated (disconnected) from the refill-side coupler 134, the capacities of the channels 82*c* and 134*d* do not fluctuate either, because only an operation reversed from the operation described above is performed. Thus, even when the discharge-side coupler 82 is connected and separated to/from the refill-side coupler 134, the fluid pressure fluctuation associated with the capacity fluctuation etc. of the channels 82*c* and 134*d* does not occur. Therefore, disadvantages, such as the fluid becomes at a high pressure and leaks when connecting and disconnecting the discharge-side coupler 82 to/from the refill-side coupler 134, and the fluid becomes at a negative pressure to generate air bubbles, can be prevented. Although one example where the discharge-side coupler 82 is a male socket and the refill-side coupler 134 as a female socket is illustrated in this embodiment, the present invention is not necessarily limited to this structure but may have the male and female of the sockets reversed. If the discharge-side coupler 82 is a female type and the refill-side coupler 134 is male type, the fluid which adheres to the discharge-side coupler 82 in connection with the refilling work of the fluid can be minimized, and disadvantages, such as the fluid is unexpectedly fallen from the discharge-side coupler 82 onto a workpiece, can be reduced.

Figure 19A:
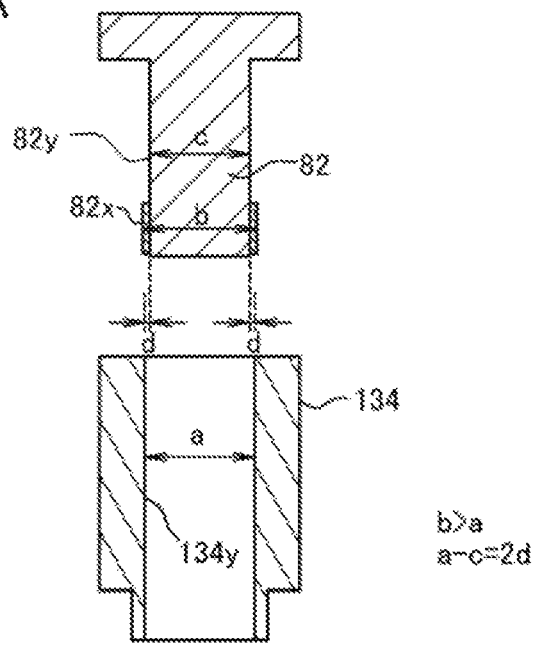
FIG. 19A is a diagram illustrating a relation of a size of a clearance between the discharge-side coupler and the refill-side coupler.

Next, the clearance between the discharge-side coupler 82 and the refill-side coupler 134 is described. The clearance between the discharge-side coupler 82 and the refill-side coupler 134 is desirable to be determined so that wear of both the couplers are minimized. Further, it is desirable to optimize the clearance according to the characteristics of the fluid which is handled in the discharge system 10. Specifically, as illustrated in FIG. 19A, assuming that an inner diameter of the refill-side coupler 134 is "a," an outer diameter of a sealing member 82*x*, such as an O-ring, attached to a tip end part of the discharge-side coupler 82 is "b," an outer diameter of the discharge-side coupler 82 is "c," and the clearance formed between the discharge-side coupler 82 and the refill-side coupler 134 is "d," relations of $c<a$ and $(a-c)=2d$ are satisfied. Further, a relation of $b>a$ needs to be satisfied in order for the sealing member 82*x* to normally demonstrate a sealing performance. In order to reduce the wear of the discharge-side coupler 82 and the refill-side coupler 134, the clearance "d" needs to be at least a positive value ($d>0$).

Here, if the fluid handled in the discharge system 10 contains particulate matters, the particulate matters may be caught in the clearance. Thus, when matters larger than the clearance "d" are contained in the particulate matters, the wear of the discharge-side coupler 82 and the refill-side coupler 134 may easily be caused.

Figure 19B:
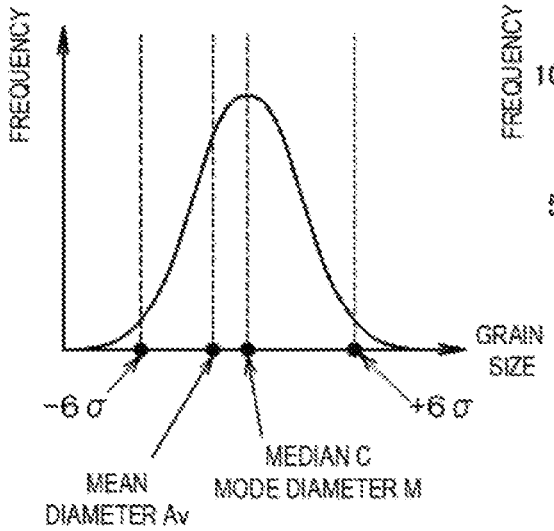
FIG. 19B is a diagram illustrating one example of a particle size distribution (frequency distribution) of particulate matters contained in fluid.
Figure 19C:
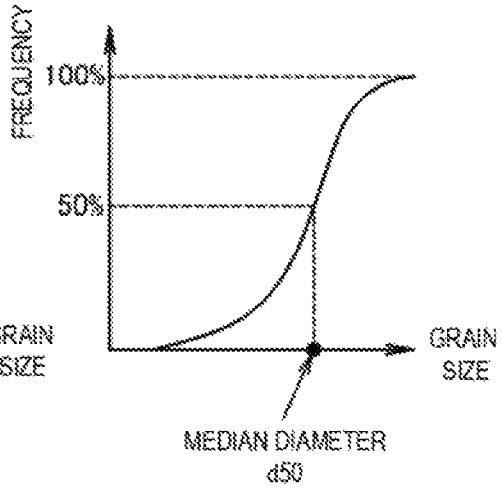
FIG. 19C is a diagram illustrating one example of a particle size distribution (cumulative distribution) of the particulate matters contained in the fluid.

In order to solve the concern described above, it is desirable to adjust the clearance "d" based on a particle size distribution of the particulate matters. Specifically, the wear of the discharge-side coupler 82 and the refill-side coupler 134 can be reduced by having the clearance "d" equal to or greater than a median C (refer to FIG. 19B). Alternatively, as an index for adjusting the clearance "d" based on the particle size distribution of the particulate matters, a mode diameter M illustrated in FIG. 19B, a median diameter d50, or a mean (average) diameter Av illustrated in FIG. 19C may be adopted instead of the median C described above, and the clearance "d" may be set to a value equal to or greater than the index value (diameter). Alternatively, as the index for adjusting the clearance "d" based on the particle size distribution of the particulate matters, the largest value among the median C, the mode diameter M, the median diameter d50, and the mean diameter Av may be adopted, and the clearance "d" may be set to a value equal to or greater than the index value (diameter). Thus, the particle size distribution is comprehensively evaluated in terms of the median C, the mode diameter M, the median diameter d50, and the mean diameter Av, and the optimization of the clearance "d" is achieved. Therefore, it is certainly possible to further reduce the wear of the discharge-side coupler 82 and the refill-side coupler 134.

Assuming that a standard deviation of the particle size distribution of the fluid is $\sigma$, the clearance "d" may also be set to $n\cdot\sigma$ or greater that corresponds to a given multiple of the standard deviation $\sigma$. Specifically, the wear described above can be eliminated by having the clearance "d" equal to or greater than the grain size corresponding to $+6\ \sigma$. The particle size distribution of the fluid hardly becomes a normal distribution. Thus, the median C is compared with the grain size corresponding to $n\cdot\sigma$, and the clearance "d" is set equal to or greater than the grain size of the larger one, to more certainly reduce the wear described above. As an approach for reducing the wear of the discharge-side coupler 82 and the refill-side coupler 134, it is desirable to have the hardness at the surface(s) of either one or both of the discharge-side coupler 82 and the refill-side coupler 134, particularly a portion that slides upon the connection and disconnection (corresponding to sliding parts 82*y* and 134*y* of the illustrated example), greater than the hardness of the particulate matters. Further, the wear described above can be prevented more certainly by determining the clearance "d" considering the particle size distribution of the particulate matters and determining the hardness of the sliding parts 82*y* and 134*y* considering the hardness of the particulate matters. In this embodiment, the hardness of the sliding parts 82*y* and 134*y* is equal to or greater than the hardness of the particulate matters.

As described above, in the discharge system 10 of this embodiment, the clearance "d" formed when the discharge-side coupler 80 is connected to the refill-side coupler 134 is determined considering the particle size distribution of the particulate matters that constitute the fluid. Specifically, it is determined considering the median C, the mode diameter M, the median diameter d50, the mean diameter Av, or the $n\cdot\sigma$ value corresponding to a given multiple of the standard deviation σ, of the particle size distribution. Thus, according to the discharge system 10 described above, even when the fluid which contains the particulate matters is handled, the wear of the discharge-side coupler 80 and the refill-side coupler 134 which is caused under the influence of the particulate matters, can be minimized. By using the largest one among the median C, the mode diameter M, the median diameter d50, and the mean diameter Av of the particle size distribution as a reference value as described above, the clearance "d" is determined to be equal to or greater than the reference value. Thus, the particle size distribution is comprehensively evaluated from various viewpoints, and the clearance is optimized. Similarly, also by setting the clearance "d" to the size equal to or greater than the grain size of the larger one among the median C and the n·σ value of the particle size distribution, the particle size distribution can be variously evaluated, and the clearance can be optimized.

As described above, in the discharge system 10 of this embodiment, the control that opens the valve 106 (supply control of the fluid) is performed so that the supply of the fluid from the fluid feeder 160 is permitted when the connected state detector detects a connection between the discharging device 20 and the refilling device 100. Thus, a leak of the fluid which is caused under the influence of the pressure acting from the fluid feeder 160 side when connecting the discharging device 20 to the refilling device 100 can be reduced.

Further, in the above embodiment, the refilling device 100 includes the refill-side detachable part 104 and the valve 106, the refill-side detachable part 104 has the communicating path 130*c* that communicates with the refill-side coupler 134, and the valve 106 is connected to the communicating path 130*c*. Thus, the refill side connecting part 104 can be avoid from being high in pressure by carrying out the opening and closing control of the valve 106. Note that although in this embodiment, one example in which the refilling device 100 has the valve 106 built therein is illustrated, the present invention is not limited to this structure but the valve 106 may be disposed at a position upstream of the refill-side coupler 134 in the fluid flow direction, such as at an intermediate position of piping which connects the refilling device 100 to the fluid feeder 160.

In the discharge system 10 described above, the valve 106 is closed so that the supply of the fluid from the fluid feeder 160 is prevented when the refilled amount in the discharging device 20 reaching more than a given amount is detected. Thus, an unexpected fluid leak can be prevented also when separating the discharging device 20 from the refilling device 100 after the discharging device 20 is refilled with the fluid. As described above, in the discharge system 10 of this embodiment, the connecting operation in which the discharge-side coupler 82 on the discharging device 20 side is connected to the refill-side coupler 134 on the refilling device 100 side in order to refill the fluid is carried out inside the sealed space 135 decompressed to a negative pressure by the decompressor 148. Thus, a possibility that air enters into the discharging device 20 and the refilling device 100 in association with the connecting operation can be reduced. Therefore, according to the discharge system 10, a poor discharge of the fluid associated with aeration can be minimized. Note that although the discharge system 10 of this embodiment illustrates one example in which the sealed space 135 can be decompressed to the negative pressure by the decompressor 148, the present invention is not limited to this structure. That is, if the poor discharge etc. of the fluid associated with the aeration does not need to be taken into consideration, the structures, such as the sealed space forming body 132 that constitutes the sealed space 150 and the decompressor 148, can be omitted. In this case, the criterion related to the completion of vacuuming (Step 8) is omitted from the criterion in which the valve 106 is opened to start the feeding of the fluid at Step 9 described above, and the valve 106 may be opened when the criterion in which the connection of the discharging device 20 to the refilling device is detected (Step 7) is satisfied.

Figure 14C:
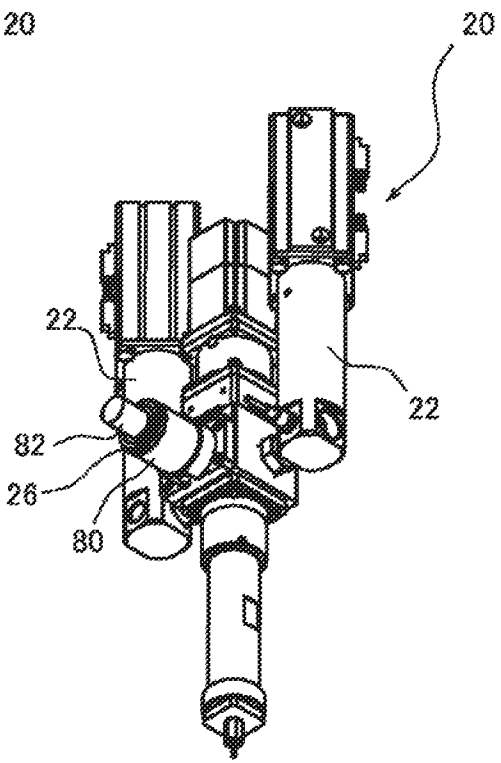
FIGS. 14A to 14C are views illustrating a first modification of the discharging device illustrated in FIGS. 2A to FIG. 2E, where
Figure 14B:
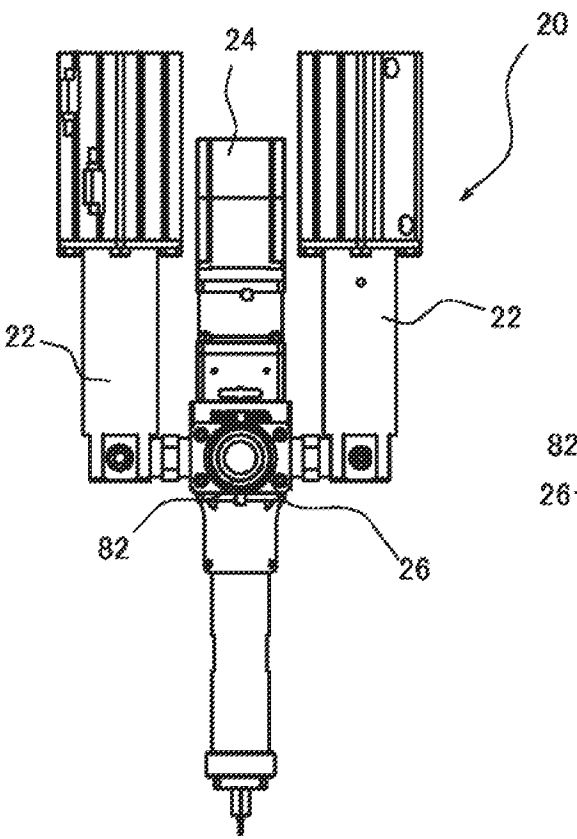
Figure 14A:
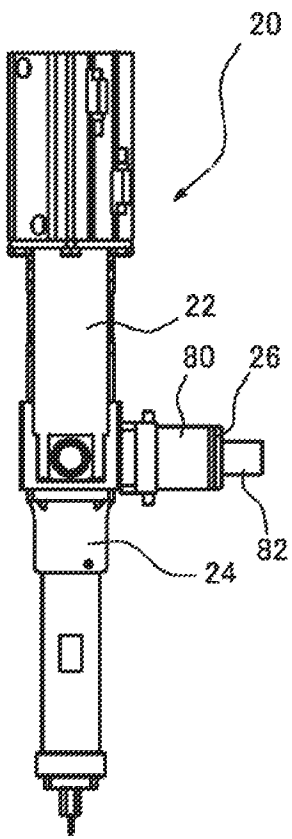

In the discharge system 10 of this embodiment described above, the discharging device 20 and the refilling device 100 are provided with the discharge-side buffer part 22 and the refill-side buffer part 102, as the shock absorbers that buffer the variation of the internal pressure associated with the connection and disconnection of the discharging device 20 to/from the refilling device 100, respectively. Thus, when connecting and disconnecting the discharging device 20 to/from the refilling device 100, the insides of the discharging device 20 and the refilling device 100 being at the negative pressure can be reduced, and the poor discharge of the fluid associated with the air entry into both the devices 20 and 100 can be reduced more certainly. In the discharge system 10, the discharge-side buffer part 22 provided with the cylinder mechanism is provided as the shock absorber on the discharging device 20 side. In the discharge-side buffer part 22, the piston 34 ascends as the fluid flows into the second chamber 44 during the refilling operation, thereby expanding the capacity of the second chamber 44. By operating the discharge-side buffer part 22 in this way, it can avoid that the inside of discharging device 20 becomes at the negative pressure, and the air entry into the discharging device 20 can be reduced. Thus, the poor discharge of the fluid can be reduced more certainly. In the discharge system 10 of this embodiment, the refill-side buffer part 102 provided with the absorber mechanism that operates using the biasing force of the spring 116 is provided as the shock absorber on the refilling device 100 side. Thus, it is possible to reduce the inside of the refilling device 100 being at the negative pressure, and the air entry into the refilling device 100 can be reduced, which are associated with the connection and disconnection of the discharging device 20 to/from the refilling device 100. In this embodiment, although one example in which the shock absorber provided with the cylinder mechanism is adopted as the discharge-side buffer part 22 on the discharging device 20 side, and the shock absorber provided with the absorber mechanism is provided as the refill-side buffer part 102 on the refilling device 100 side, is illustrated, the present invention is not limited to this structure. Specifically, as the shock absorber provided on the discharging device 20 side, one corresponding to the refill-side buffer part 102 provided with the absorber mechanism may be provided. Similarly, as the shock absorber provided on the refilling device 100 side, one corresponding to the discharge-side buffer part 22 provided with the cylinder mechanism may be provided. In this embodiment, although one example in which one shock absorber which forms the discharge-side buffer part 22, and one shock absorber which forms the refill-side buffer part 102 are respectively provided to the discharging device 20 and the refilling device 100, is illustrated, the present invention is not limited to this structure. Specifically, as illustrated in FIG. 14A to FIG. 14C, the discharging device 20 may be comprised of two or more shock absorbers which forms the discharge-side buffer part 22. Although in this embodiment, as one example of the shock absorbers provided to the discharging device 20 and the refilling device 100, the discharge-side buffer part 22 provided with the cylinder mechanism and the discharge-side buffer part 22 provided with the absorber mechanism is illustrated, the present invention is not limited to this structure but the shock absorber may be comprised of an accumulator of other types, or a tank where the fluid inflows and outflows. Such a structure also reduces that the inside of the discharging device 20 or the refilling device 100 becomes at the negative pressure associated with the connecting and disconnecting operations, and can avoid the poor discharge of the fluid associated with the aeration.

Note that although in this embodiment, the structure provided with the discharge-side buffer part 22 and the refill-side buffer part 102 is illustrated, the present invention is not limited to this structure. That is, if the air entry associated with the connection and disconnection of the discharging device 20 to/from the refilling device 100 does not need to be taken into consideration, it is possible to omit either one or both of the discharge-side buffer part 22 and the refill-side buffer part 102. The discharge system 10 of this embodiment includes the disconnection preventive mechanism 150 comprised of the positioning pin 142 and the latch grooves 144. Thus, in the state where the discharging device 20 is connected to the refilling device 100 for refilling of the fluid, the disconnection of the discharging device 20 from the refilling device 100 can certainly be prevented. Note that the disconnection preventive mechanism 150 illustrated in this embodiment is merely one example, and it is also possible to use a catch lock including a known ball catch lock, a hook, a fastener, etc. as the disconnection preventive mechanism 150. Alternatively, if the problem of the discharging device 20 disconnecting from the refilling device 100 does not occur when refilling the discharging device 20 with the fluid, it is not necessary to provide the disconnection preventive mechanism 150. The discharge system 10 described above adopts the uniaxial eccentric screw pump as the discharge part 24 of the discharging device 20. Thus, it can discharge the fluid quantitatively and stably, without causing the fluctuation etc. of the fluid which is refilled to the discharging device 20 from the refilling device 100. In the discharge system 10, the poor discharge of the fluid associated with the aeration hardly occurs. Therefore, the discharge system 10 is very high in the discharge performance of the fluid, and can be suitably used in an application of, for example, applying fluid, such as sealing agent or adhesive, to various components at an automobile assembly plant etc. In the discharge system 10 described above, the axial direction of the discharge-side coupler 82 provided to the discharge-side detachable part 26 of the discharging device 20 intersects with (substantially perpendicular to) the axial direction of the discharge part 24. Thus, when connecting the discharging device 20 to the refilling device 100 installed on a floor etc., the discharge part 24 is oriented to be in a substantially horizontal posture, and the discharging device 20 is descended to the refilling device 100 side so that the discharge-side coupler 82 is fitted into the refill-side coupler 134. Therefore, if the discharging device 20 is structured as described above, in order to certainly fit the discharge-side coupler 82 into the refill-side coupler 134 without a complicated operation of the manipulator 90, it is desirable to attach the arm of the manipulator 90 to the discharge part 24, at a position along the axis of the discharge-side coupler 82.

Figure 15C:
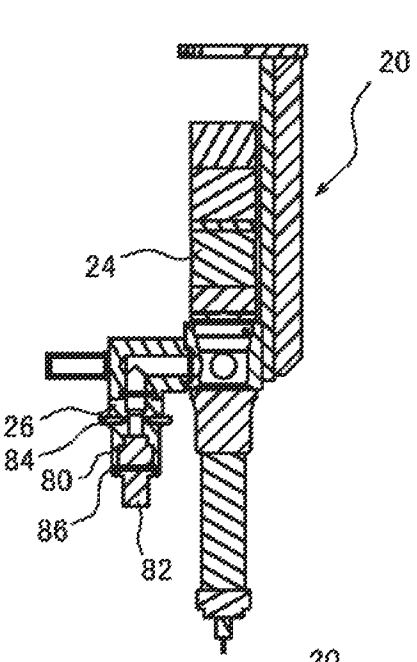
FIGS. 15A to 15D are views illustrating a second modification of the discharging device illustrated in FIG. 2A to FIG. 2E, where
Figure 15B:
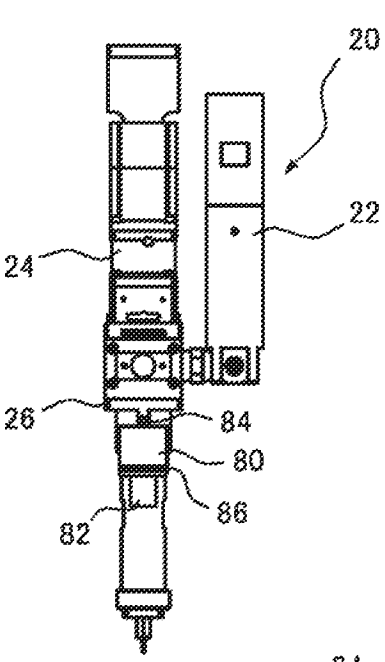
Figure 15A:
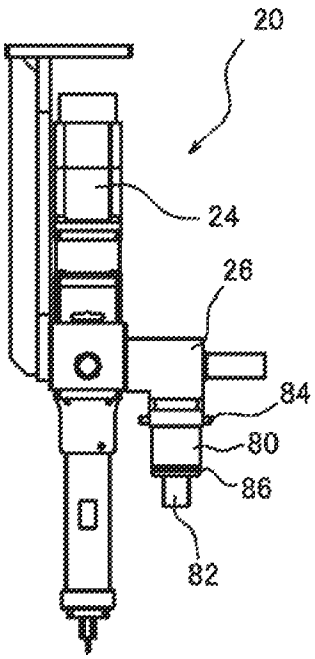
Figure 15D:
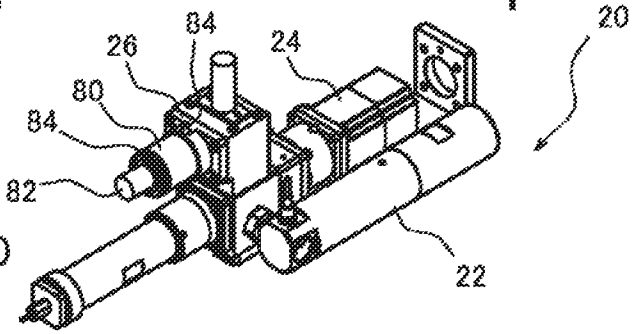

Other than that, if the arm of the manipulator 90 is attached at the position along the axis of discharge parts 24, such as in an upper part of the discharge part 24, it is desirable to arrange the arm so that the axial direction of the discharge-side coupler 82 is oriented along the axial direction of the discharge part 24 (substantially parallel in the illustration), as illustrated in FIG. 15A to FIG. 15C. If such a structure is adopted, as illustrated in FIGS. 16(*a*) to (*i*), the discharge part 24 is oriented in a substantially vertical posture, and the discharging device 20 is then descended to the refilling device 100 side. Thus, the discharge-side coupler 82 is fitted into the refill-side coupler 134 without a complicated operation of the manipulator 90 to connect both the couplers so that a refilling operation of the fluid can be carried out.

In the discharge system 10 of this embodiment, the bolts 138 are removed on the refilling device 100 side to remove the sealed space forming body 132 from the refill-side detachable part main body 130, and maintenance, such as cleaning, of the refill-side coupler 134 is then carried out. Note that although one example in which the sealed space forming body 132 is attachable and detachable is illustrated in this embodiment, the present invention is not limited to this structure but the refill side detaching part main body 130 and the sealed space forming body 132 may be integrally formed. Note that in the discharge system 10 of this embodiment, when connecting and disconnecting the discharging device 20 to/from the refilling device 100 for refilling of the fluid, if the operating speed at the time of disconnection is a higher than the operating speed at the time of connection, the fluid is adhered to the connecting device 140 without the adhered fluid being scraped and, thus, the fluid leaks outside. Therefore, one example in which the separating speed V2 of the discharging device 20 from the refilling device 100 is controlled so as to be equal to or below the connecting speed V1 ($|V1| \geq |V2|$) based on the knowledge described above, is illustrated. However, it is not necessary to perform this control. That is, if the leak etc. of the fluid outside the connecting device 140 does not need to be taken into consideration, or if other measures to the leak of the fluid is taken, the separating speed V2 of the discharging device 20 from the refilling device 100 may be higher than the connecting speed V1, for example.

[Modification of Connected State Detector and Modification of Operation of Discharge System 10]

In this embodiment, although one example in which the connection between the discharging device 20 and the refilling device 100 is detected with the docking completion limit switch 174, and the fluid is refilled to the discharging device 20 side from the refilling device 100 side when the connection between the discharging device 20 and the refilling device 100 is detected, is illustrated, the present invention is not limited to this structure. Specifically, the above embodiment illustrates the structure provided with the disconnection preventive mechanism 150. Thus, in the above embodiment, the criteria of starting the refill of the discharging device 20 with the fluid are, in addition to a connection between the discharge-side coupler 82 and the refill-side coupler 134, a spatial relationship so that the discharging device 20 and the refilling device 100 are locked by the disconnection preventive mechanism 150. However, if the problem, such as the fluid leak, does not occur even when the fluid refill is started before the lock by the disconnection preventive mechanism 150 is finished, or if the disconnection preventive mechanism 150 is not provided, the fluid refill may be started at the timing when the discharge-side coupler 82 is connected to the refill-side coupler 134. Therefore, if the lock by the disconnection preventive mechanism 150 is not essential for the trigger of the fluid refill start, or if the disconnection preventive mechanism 150 is not provided, the connected state detector for detecting the connection of the discharge-side coupler 82 to the refill-side coupler 134 may be provided instead of the docking completion limit switch 174, and the detection of the connection may be used as the criterion of the refill start. Alternatively, instead of the docking completion limit switch 174, a position of the manipulator 90 (moving coordinates) may be detected, and the connection of the discharge-side coupler 82 to the refill-side coupler 134 may be detected by using the detected position (moving coordinates) as an index.

Figure 18:
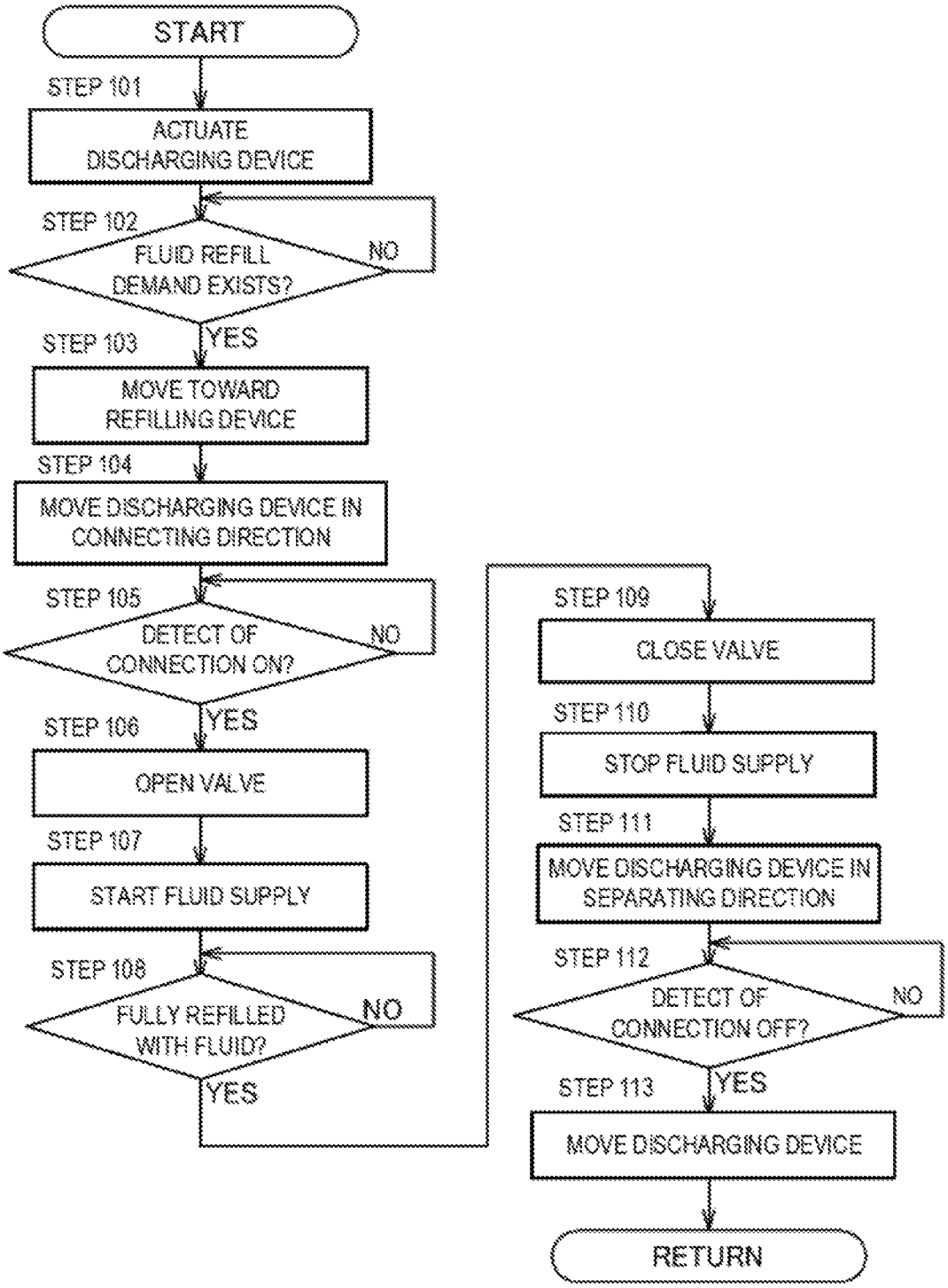
FIG. 18 is a flowchart illustrating a modification of the operation of the discharge system.

Specifically, if the disconnection preventive mechanism 150 is not provided, the operation may be controlled by the controller 170 like the flowchart illustrated in FIG. 18. That is, at Step 101 of FIG. 18, the discharging device 20 operates to discharge the fluid. After the operation of the discharging device 20, when the controller 170 determines at Step 102 that the demand of refilling the discharging device 20 with the fluid is outputted, the control flow transits to Step 103. Here, the existence of the refill demand at Step 102 may be similar to that of Step 2 of the control flow illustrated in FIG. 7 described above. That is, the existence of the refill demand can be determined based on various criteria, such as the pressure sensor (not illustrated) which is detectable of the internal pressure of the discharge-side buffer part 22 provided to the discharging device 20 measures a pressure below the given pressure. If the existence of the fluid refill demand is confirmed at Step 102, the flow transits to Step 103. At Step 103, the controller 170 controls the operation of the manipulator 90 so that the discharging device 20 moves to a given position on the refilling device 100 side. When the discharging device 20 reaches the given position, the controller 170 controls the operation at Step 104 in which the discharge-side coupler 82 is moved in the connecting direction (downward in the axial direction of the refill-side coupler 134 in this embodiment). Thus, the connection of the discharge-side coupler 82 to the refill-side coupler 134 is started. The movement of the discharging device 20 in the connecting direction is continued until the connected state detector (not illustrated) confirms the connection of the discharge-side coupler 82 to the refill-side coupler 134 at Step 105.

If the connection of the discharge-side coupler 82 to the refill-side coupler 134 is confirmed at Step 105, the control flow transits to Step 106, where the valve 106 is opened. Next, at Step 107, the supply of the fluid from the fluid feeder 160 to the refilling device 100 side is started. Then, the refill of the discharging device 20 with the fluid is continued until the refilled amount detector confirms the fully-refilled state at Step 108. Here, variety of refilled amount detector for detecting the refilled state of the fluid at Step 108 may be adopted similar to Step 10 of FIG. 7 described above. If the discharging device 20 is fully refilled with the fluid, the control flow transits to Step 109. At Step 109, the valve 106 is closed. Then, at Step 110, the supply of the fluid from the fluid feeder 160 to the refilling device 100 side is stopped. At Step 111, the controller 170 executes the operational control so that the discharge-side coupler 82 is moved in the separating direction (upward in the axial direction of the refill-side coupler 134 in this embodiment). Thus, the operation of disconnecting the discharge-side coupler 82 from the refill-side coupler 134 is started. The movement of the discharging device 20 in the disconnecting direction is continued until the connected state detector (not illustrated) is turned off at Step 112. If the connected state detector is turned off at Step 112, the controller 170 executes the operational control so that the discharging device 20 is moved to the given position at Step 113. Thus, the refill operation of the fluid illustrated in FIG. 18 is finished.

[Discharge-side Coupler 82 and Refill-side Coupler 134]

Although one example in which the discharge-side coupler 82 is the male plug and the refill-side coupler 134 is the female plug is illustrated in this embodiment, the present invention is not limited to this structure. That is, the discharge-side coupler 82 may be a female plug, and the refill-side coupler 134 may be a male plug, and the refill-side coupler 134 may be inserted into the discharge-side coupler 82 at the time of connection for the fluid refilling. Here, if the adhered amount of the fluid associated with the fluid refilling is compared between the male plug and the female plug, the adhered amount to the female plug is relatively less. Thus, as described above, by using the female plug as the discharge-side coupler 82 on the discharging device 20 side which operates at the position near the workpiece to which the fluid is applied, the adhesion of the fluid to the discharge-side coupler 82 can be minimized, and it is avoidable that the fluid adhered to the discharge-side coupler 82 is suddenly fallen etc. onto the workpiece during the operation of the discharging device 20.

In addition, if the discharge-side coupler 82 is the female plug, it is desirable to attach the sealing member, such as an O-ring, onto the circumference of the refill-side coupler 134 which is the male plug. Thus, even if the fluid adheres to the inner circumferential surface of the discharge-side coupler 82, the effect of the sealing member scraping the fluid off the inner circumferential surface of the discharge-side coupler 82 can be expected when connecting or disconnecting the discharge-side coupler 82 to/from the refill-side coupler 134. Therefore, it is desirable to provide the sealing member to the male plug which forms the refill-side coupler 134. Note that although the sealing member may be attached to any locations, it is desirable to attach the sealing member to a tip end side from the base end side of the male plug which forms the refill-side coupler 134, in order to improve the scraping effect described above.

The application system of the present invention is suitably available in applications, such as applying fluid, such as sealing agent or adhesive, to various components at an automobile assembly plant etc., or refilling a container with fluid, such as grease.

What is claimed is:

1. A method of creating a discharge system for fluid with a predetermined particle size distribution of the particulate matters, said method comprising:

identifying particulate matters in a fluid intended to be dispensed from the discharge system;

determining a mode diameter of a particle size distribution of identified particulate matters in a fluid to be dispensed from the discharge system;

providing a discharging device configured to accept the fluid through a discharge-side coupler;

providing a refilling device configured to refill the discharging device with the fluid through a refill-side coupler;

creating a clearance between sliding parts which slide upon the connection and disconnection of the discharge-side coupler and the refill-side coupler; determining the clearance as large as six times of the standard deviation $\sigma$ of the particle size distribution of the mode diameter of the predetermined particle size distribution of particulate matters of the fluid to be dispensed from the refilling device to the discharging device; and, determining a hardness of either one or both of a surface of a sliding part of the discharge-side coupler that slides when connecting and disconnecting the discharge-side coupler to/from the refill-side coupler and a surface of the refill-side coupler equal to or greater than a hardness of the particulate matters.

2. The method of claim 1, wherein said clearance is a half of a distance obtained by subtracting an outer diameter of the discharge-side coupler from an inner diameter of the refill side coupler or an outer diameter of the refill-side coupler from an inner diameter of the discharge-side coupler.

3. The method of claim 2, wherein said clearance minimize the wear of sliding parts of the discharge-side coupler and the refill-side coupler.

4. A method of handling a fluid with a predetermined particle size distribution of the particulate matters in a discharge system, said method comprising:

identifying particulate matters in a fluid intended to be dispensed from the discharge system;

determining a mode diameter of a particle size distribution of identified particulate matters in a fluid to be dispensed from the discharge system;

providing a discharging device configured to accept the fluid through a discharge-side coupler;

providing a refilling device configured to refill the discharging device with the fluid through a refill-side coupler;

creating a clearance between sliding parts which slide upon the connection and disconnection of the discharge-side coupler and the refill-side coupler; determining the clearance as large as six times of the standard deviation a of the particle size distribution of the mode diameter of the predetermined particle size distribution of particulate matters of the fluid to be dispensed from the refilling device to the discharging device;

determining a hardness of either one or both of a surface of a sliding part of the discharge-side coupler that slides when connecting and disconnecting the discharge-side coupler to/from the refill-side coupler and a surface of the refill-side coupler equal to or greater than a hardness of the particulate matters; and supplying the fluid from the refilling device side to the discharging device side.

5. The method of claim 4, wherein said clearance is a half of a distance obtained by subtracting an outer diameter of the discharge-side coupler from an inner diameter of the refill side coupler or an outer diameter of the refill-side coupler from an inner diameter of the discharge-side coupler.

6. The method of claim 4, wherein said clearance minimize the wear of sliding parts of the discharge-side coupler and the refill-side coupler.

* * * * *